US009457972B2

(12) United States Patent
Yamashita

(10) Patent No.: US 9,457,972 B2
(45) Date of Patent: Oct. 4, 2016

(54) MEDIUM PROCESSING DEVICE

(71) Applicant: Oki Electric Industry Co., Ltd., Tokyo (JP)

(72) Inventor: Yuusuke Yamashita, Tokyo (JP)

(73) Assignee: OKI ELECTRIC INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 14/441,163

(22) PCT Filed: Oct. 8, 2013

(86) PCT No.: PCT/JP2013/077389

§ 371 (c)(1),
(2) Date: May 6, 2015

(87) PCT Pub. No.: WO2014/077054

PCT Pub. Date: May 22, 2014

(65) Prior Publication Data

US 2015/0298920 A1 Oct. 22, 2015

(30) Foreign Application Priority Data

Nov. 14, 2012 (JP) ..... 2012-250238

(51) Int. Cl.

| | |
|---|---|
| ***B65H 1/08*** | (2006.01) |
| ***B65H 1/02*** | (2006.01) |
| ***G07D 11/00*** | (2006.01) |
| ***B65H 1/26*** | (2006.01) |
| ***B65H 29/26*** | (2006.01) |

(52) U.S. Cl.

CPC ..... *B65H 1/025* (2013.01); *B65H 1/022* (2013.01); *B65H 1/26* (2013.01); *B65H 29/26* (2013.01); *G07D 11/0018* (2013.01); *B65H 2402/442* (2013.01); *B65H 2601/322* (2013.01)

(58) Field of Classification Search

CPC ..... G07D 11/0024; G07D 11/0027; G07D 11/003; G07D 11/0033; B65H 1/02; B65H 1/025; B65H 1/022; B65H 3/0653; B65H 2404/722; B65H 2404/721; B65H 2404/725; B65H 2407/32; B65H 2405/20; B65H 2405/21; B65H 2405/22; B65H 2405/214; B65H 2405/115; B65H 2405/321

USPC ..... 271/121, 122, 125, 149, 117, 126, 127; 235/379; 194/206, 207, 350, 351; 209/534

See application file for complete search history.

(56) References Cited

U.S. PATENT DOCUMENTS

| | | | | | |
|---|---|---|---|---|---|
| 3,539,179 | A | * | 11/1970 | Bergman et al. | 271/124 |
| 4,733,765 | A | | 3/1988 | Watanabe | |
| 5,154,408 | A | * | 10/1992 | Stepan et al. | 271/121 |
| 7,712,596 | B2 | * | 5/2010 | Park et al. | 194/206 |
| 2008/0217840 | A1 | * | 9/2008 | Shiraki et al. | 271/126 |
| 2011/0155540 | A1 | | 6/2011 | Ugajin | |

FOREIGN PATENT DOCUMENTS

| | | | | |
|---|---|---|---|---|
| JP | S61-168466 | U | | 10/1986 |
| JP | 62-79135 | | * | 4/1987 |
| JP | S62-274391 | A | | 11/1987 |
| JP | 2011-008412 | A | | 1/2011 |

* cited by examiner

*Primary Examiner* — Thomas Morrison
(74) *Attorney, Agent, or Firm* — Rabin & Berdo, P.C.

(57) ABSTRACT

A medium processing device including a holding section that includes an opening forming a medium insertion port, and that holds a medium inserted through the insertion port, a medium press section that is capable of moving between a first end side wall and a second end side wall of the holding section, and that presses the medium inserted through the insertion port against the second end side wall of the holding section, and an opening-out section that spans between the medium press section and the first end side wall of the holding section, and that opens out in a medium non-holding area between the medium press section and the first end side wall of the holding section accompanying movement of the medium press section from the first end side to the second end side of the holding section in order to press the medium inserted into a medium holding area between the medium press section and the second end side wall of the holding section against the second end side wall of the holding section.

11 Claims, 16 Drawing Sheets

MEDIUM PROCESSING DEVICE

TECHNICAL FIELD

The present invention relates to a medium processing device suitable for application in, for example, a banknote processing device that handles banknotes as a medium.

BACKGROUND ART

A banknote processing device of related art includes a pay-in section 200 such as that illustrated in FIG. 19A and FIG. 19B. The pay-in section 200 includes a holding section 200A in the shape of a box open at an upper face. A portion of the opening of the holding section 200A forms a banknote insertion port 200B.

A banknote intake port 200C for banknotes inserted into the holding section 200A is provided at the bottom of the holding section 200A on one end side thereof (for example a rear end side).

The pay-in section 200 is provided with pick-up rollers 201 of which a portion projects out from a rear wall of the holding section 200A, and a plate-shaped bill press 202 capable of sliding in the front-rear direction in a state parallel to the rear wall of the holding section 200A inside the holding section 200A.

A feed roller 203 and a gate roller 204 are provided facing each other in the front-rear direction close underneath the intake port 200C.

In practice, during banknote insertion, the bill press 202 of the pay-in section 200 is positioned in the vicinity of the front wall of the holding section 200A, and the opening of a portion between the bill press 202 and the and the rear wall of the holding section 200A forms the insertion port 200B.

In the pay-in section 200, banknotes BL are inserted into an area between the bill press 202 and the rear wall of the holding section 200A (also referred to as a banknote holding area) Ar10 through the insertion port 200B.

Then in the pay-in section 200, the bill press 202 slides so as to approach the rear wall of the holding section 200A, such that the banknotes BL are pressed against the pick-up rollers 201 and nipped between the bill press 202 and the pick-up rollers 201.

The banknotes BL pressed against the pick-up rollers 201 are separated one note at a time by rotation of the pick-up rollers 201, and are fed out downward toward the intake port 200C to be taken into the banknote processing device through the intake port 200C by the feed rollers 203 and the gate rollers 204.

In this manner, the banknote processing device takes in pay-in banknotes one note at a time (see, for example, Japanese Patent Application Laid-Open (JP-A) No. 2011-8412).

SUMMARY OF INVENTION

Technical Problem

When banknotes are being taken in, the bill press 202 of the pay-in section 200 slides toward the rear so as to approach the pick-up rollers 201. However, an area between the bill press 202 and the front wall of the holding section 200A (also referred to as a banknote non-holding area) Ar11 becomes wider accompanying this sliding.

The banknote non-holding area Ar11 is an area provided with an internal mechanism 205, such as a spring, for sliding the bill press 202. There is a concern that mistaken insertion of banknotes into the banknote non-holding area Ar11 could cause device malfunction of the banknote processing device.

In order to prevent such issues, the banknote processing device of the related art is provided with an electric shutter 206 at an upper side of the pay-in section 200, capable of sliding in a direction to open and a direction to close the insertion port 200B.

Namely, the banknote processing device opens the shutter 206 to expose the insertion port 200B during banknote insertion, and banknotes are inserted into the banknote holding area Ar10 through the insertion port 200B. When this is performed, the bill press 202 is positioned in the vicinity of the front wall of the holding section 200A.

Then, once banknote insertion has been completed, the shutter 206 is closed and the insertion port 200B is shut off, and then the bill press 202 slides toward the rear. When this is performed in the pay-in section 200, the banknote non-holding area Ar11 widens accompanying the sliding of the bill press 202 toward the rear; however, since the shutter 206 is closed, mistaken insertion of banknotes into the banknote non-holding area Ar11 is prevented.

In this manner, the banknote processing device of related art prevents mistaken insertion of banknotes into the banknote non-holding area Ar11 of the pay-in section 200.

However, when the electric shutter 206 is added as described above, a separate drive section such as a motor to slide the shutter 206 has to be added, and sliding of the shutter 206 has to be controlled. This leads to the new issue of a corresponding increase in the complexity of the banknote processing device configuration.

In consideration of the above circumstances, the present invention proposes a medium processing device that prevents mistaken medium insertion with a simple configuration.

Solution to Problem

In order to address the above issue, a medium processing device of the present invention includes: a holding section that includes an opening forming a medium insertion port, and that holds a medium inserted through the insertion port; a medium press section that is capable of moving between a first end side wall and a second end side wall of the holding section, and that presses the medium inserted through the insertion port against the second end side wall of the holding section; and an opening-out section that spans between the medium press section and the first end side wall of the holding section, and that opens out in a medium non-holding area between the medium press section and the first end side wall of the holding section accompanying movement of the medium press section from the first end side to the second end side of the holding section in order to press the medium inserted into a medium holding area between the medium press section and the second end side wall of the holding section against the second end side wall of the holding section.

The opening-out section spanning between the medium press section and the first end side wall of the holding section accordingly opens out in the medium non-holding area between the medium press section and the first end side wall of the holding section accompanying the movement of the medium press section. This enables a user to recognize that the medium is not to be inserted into the medium non-holding area between the medium press section and the first end side wall of the holding section, and enables mistaken insertion of the medium into the medium non-holding area to be prevented, without separately providing extensive additional mechanisms such as an electric shutter.

Advantageous Effects of Invention

The present invention enables a user to recognize that the medium is not to be inserted into the medium non-holding area, and enables mistaken insertion of the medium into the medium non-holding area to be prevented, without separately providing extensive additional mechanisms such as an electric shutter, and enables a medium processing device that prevents mistaken medium insertion to be achieved with a simple configuration.

DESCRIPTION OF EMBODIMENTS

Detailed explanation follows regarding exemplary embodiments of the present invention, with reference to the drawings.

Figure 1:
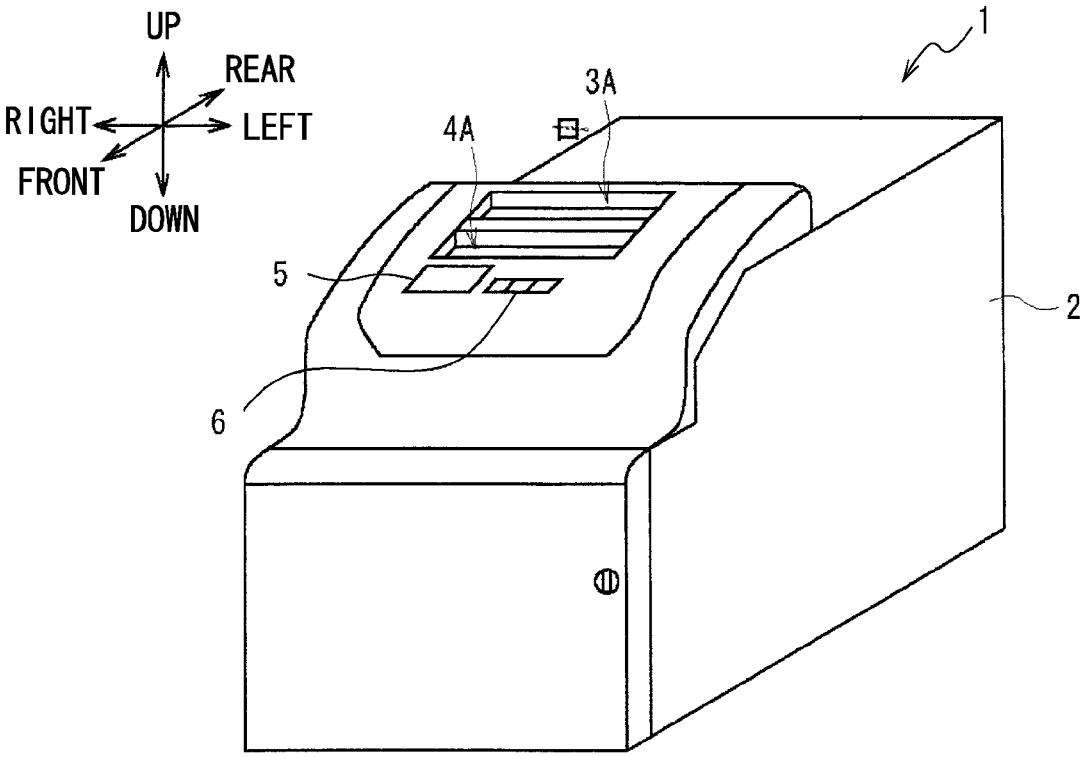
FIG. 1 is a schematic line drawing illustrating an external configuration of a banknote processing device.

1. First Exemplary Embodiment 1-1. External Configuration of Banknote Processing Device First, explanation follows regarding a first exemplary embodiment. FIG. 1 illustrates an external configuration of a banknote processing device 1. The banknote processing device 1 is a staff/customer operated terminal operated by an employee of a financial institution (for example a service window cashier), or a customer of the financial institution. Pay-in and pay-out processing is performed based on operation by the cashier or customer.

The banknote processing device 1 includes an insertion port 3A of a pay-in section 3 (see FIG. 2), a discharge port 4A of a pay-out section 4 (see FIG. 2), a display section 5, and a operation section 6, at an upper end portion of a casing 2.

On insertion of pay-in banknotes through the insertion port 3A by the cashier, the pay-in section 3 separates and takes the pay-in banknotes inside the banknote processing device 1 one note at a time.

The pay-out section 4 accumulates pay-out banknotes for removal from the discharge port 4A by the cashier. The pay-out section 4 is also provided with a shutter that opens and closes the discharge port 4A. The shutter opens when dispensing banknotes.

The display section 5 is, for example, a liquid crystal display, and displays menu screens, result screens for various processing, and the like. The operation section 6 is, for example, configured by buttons, and accepts operation of the banknote processing device 1.

The display section 5 and the operation section 6 are separately provided in the banknote processing device 1; however, the display section 5 and the operation section 6 may be provided as a single unit, for example by employing a liquid crystal display with a touch panel or the like.

The banknote processing device 1 is moreover capable of communicating with other terminals in the financial institution, and a host computer, through a network, and is capable of exchanging various data with the other terminals and the host computer, and of being operated from the side of the other terminals.

1-2. Internal Configuration of Banknote Processing Device

Figure 2:
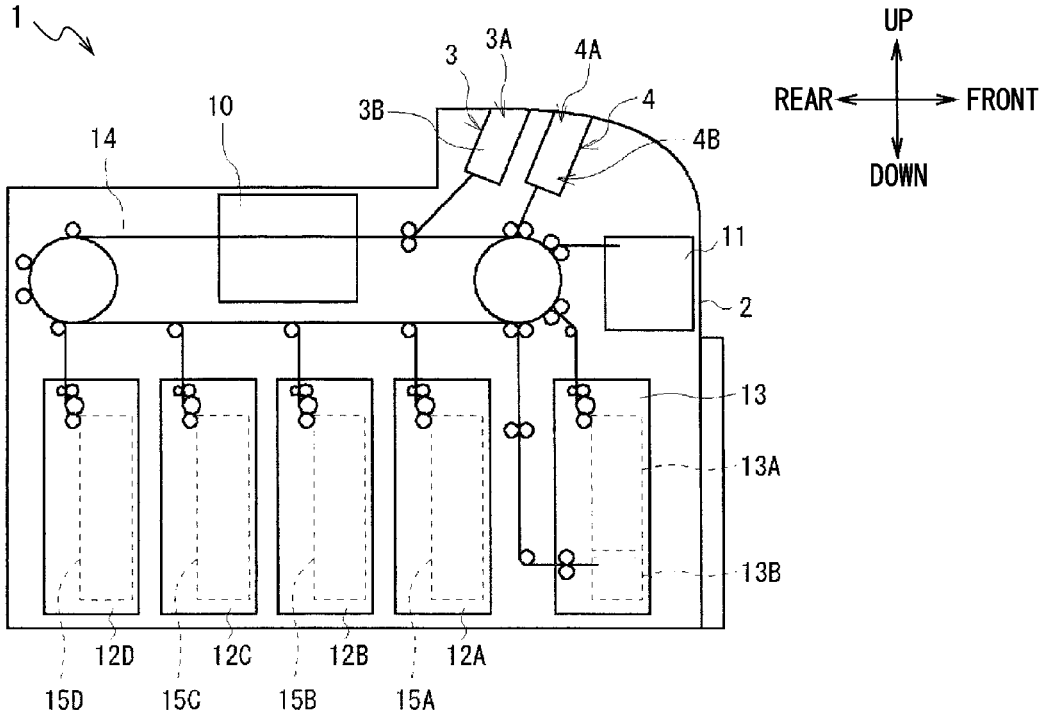
FIG. 2 is a schematic line drawing illustrating an internal configuration of a banknote processing device.

Next, explanation follows regarding internal configuration of the banknote processing device 1, with reference to FIG. 2.

In addition to the pay-in section 3 and the pay-out section 4 mentioned above, a classification section 10, a temporary retention section 11, banknote cassettes 12A to 12D, a reject box-provided banknote cassette 13, and a conveyance path 14 are provided inside the casing 2 of the banknote processing device 1.

More specifically, the pay-in section 3 and the pay-out section 4 are provided in a row along the front-rear direction at an upper portion inside the casing 2, such that the pay-in section 3 is at the rear side and the pay-out section 4 is at the front side.

The temporary retention section 11 is provided diagonally below the front of the pay-out section 4, and the classification section 10 is provided diagonally below the rear of the pay-in section 3 and to the rear of the temporary retention section 11.

The banknote cassettes 12A to 12D and the reject box-provided banknote cassette 13 are provided in a row along the front-rear direction in a lower portion inside the casing 2.

In the banknote processing device 1, the reject box-provided banknote cassette 13 is at the frontmost side, and the banknote cassettes 12A to 12D are provided in a row behind the reject box-provided banknote cassette 13, in the sequence banknote cassette 12A, 12B, 12C, 12D.

The conveyance path 14 is provided connecting together each of the pay-in section 3, the pay-out section 4, the classification section 10, the temporary retention section 11, the banknote cassettes 12A to 12D, and the reject box-provided banknote cassette 13 inside the casing 2.

The pay-in section 3 includes a holding section 3B in the shape of a box open at an upper face. A portion of the opening of the holding section 3B forms the insertion port 3A mentioned above. During a pay-in transaction, pay-in banknotes inserted into the holding section 3B through the insertion port 3A are separated and taken into the banknote processing device 1 one note at a time by the pay-in section 3.

The pay-out section 4 includes an accumulation section 4B in the shape of a box open at an upper face. The opening of the accumulation section 4B forms the discharge port 4A mentioned above. During a pay-out transaction, the pay-out section 4 accumulates pay-out banknotes conveyed from the banknote cassettes 12A to 12D or the like in the accumulation section 4B.

The pay-out section 4 also includes a shutter that opens and closes the discharge port 4A. The shutter opens after pay-out banknotes have been accumulated in the accumulation section 4B, and opening the shutter enables the cashier to remove the pay-out banknotes accumulated in the accumulation section 4B from the discharge port 4A.

The pay-in section 3 and the pay-out section 4 are fixed inclined toward the front such that upper end portions thereof are positioned further toward the front than lower end portions. There is no limitation to fixing the pay-in section 3 and the pay-out section 4 in this manner, and, for example, the pay-in section 3 and the pay-out section 4 may be movable so as to allow adjustment of the front-rear direction incline.

The classification section 10 classifies banknotes conveyed one note at a time by the conveyance path 14 by denomination, authenticity, physical condition, running state and the like. The classification section 10 then determines whether each banknote is a normal banknote that may be transacted, or a reject banknote that may not be transacted, based on the classification results.

The temporary retention section 11 temporarily accumulates banknotes taken in from the pay-in section 3 that have been determined by the classification section 10 to be normal banknotes. After completion of the transaction, the banknotes thus accumulated in the temporary retention section 11 are fed out from the temporary retention section 11 and conveyed to the classification section 10, and after identification of the denomination by the classification section 10, the banknotes are conveyed and stored in the banknote cassettes 12A to 12D.

The temporary retention section 11 may be a stacking type that accumulates by sequentially superimposing banknotes on each other, or may be a drum type that stores banknotes wrapped around a drum with a tape.

The banknote cassettes 12A to 12D each include respective upright banknote storage boxes 15A to 15D capable of storing banknotes by denomination. Banknotes conveyed up by the conveyance path 14 are stacked overlapping one another in the up-down direction inside the banknote storage boxes 15A to 15D. The banknote cassettes 12A to 12D not only store banknotes, but are also capable of feeding out the banknotes accumulated in the banknote storage boxes 15A to 15D to the conveyance path 14 one note at a time.

The banknote cassettes 12A to 12D are a detachable type and can be individually detached from the banknote processing device 1.

Although the banknote cassettes 12A to 12D are configured as a detachable type, a non-detachable fixing method may also be applied.

The reject box-provided banknote cassette 13 includes a banknote storage box 13A at an upper side, and a reject box 13B at a lower side. The reject box-provided banknote cassette 13 is also a detachable type, and can be detached from the banknote processing device 1.

In the reject box-provided banknote cassette 13, during, for example, banknote retrieval, banknotes fed out from the banknote cassettes 12A to 12D are stored in the banknote storage box 13A. The cashier then retrieves the banknotes by removing the reject box-provided banknote cassette 13 from the banknote processing device 1.

During banknote replenishment, the cashier sets the reject box-provided banknote cassette 13, in the banknote storage box 13A of which replenishment banknotes have been stored, in the banknote processing device 1. Then, the replenishment banknotes stored in the banknote storage box 13A are fed out from the reject box-provided banknote cassette 13 and conveyed via the classification section 10 to replenish the banknote cassettes 12A to 12D. Banknote replenishment of the banknote processing device 1 is performed in this manner.

The banknote storage box 13A of the reject box-provided banknote cassette 13 can accordingly be employed for multiple purposes.

The reject box 13B of the reject box-provided banknote cassette accumulates banknotes that the classification section 10 has determined to be reject banknotes.

A controller that performs overall control is provided at a specific location inside the casing 2 of the banknote processing device 1.

In the banknote processing device 1, the controller performs pay-in processing and pay-out processing of banknotes by controlling each section based on, for example, the banknote classification results of the classification section 10.

Namely, during a pay-in transaction, when the cashier inputs a transaction type (in this case, pay-in) or the like using the operation section 6, and inserts banknotes into the pay-in section 3 through the insertion port 3A, the banknote processing device 1 conveys the inserted banknotes to the classification section 10 one note at a time.

The banknote processing device 1 conveys and temporarily retains banknotes determined by the classification section 10 to be normal banknotes in the temporary retention section 11. However, any banknotes determined to be pay-in reject banknotes not suitable for pay-in are returned to the pay-out section 4, and the shutter opens, to return the banknotes to the cashier.

Then, on confirmation of the pay-in amount by the cashier, the banknotes stored in the temporary retention section 11 are conveyed to the classification section 10 for denomination classification, and are conveyed for safekeeping in the respective banknote cassettes 12A to 12D according to denomination.

During a pay-out transaction, when the cashier inputs a transaction type (in this case, pay-out), a pay-out amount and the like using the operation section 6, the banknote processing device 1 establishes the number of banknotes of each denomination required to make up the desired amount, and feeds out banknotes one note at a time from the respective banknote cassettes 12A to 12D according to the number of banknotes of each denomination, for conveyance to the classification section 10.

The banknote processing device 1 conveys banknotes determined by the classification section 10 to be normal banknotes to the pay-out section 4, and conveys banknotes determined to be pay-out reject banknotes not suitable for pay-out to the temporary retention section 11 where they are temporarily held.

The banknote processing device 1 then opens the shutter once banknotes making up the desired amount have been accumulated in the pay-out section 4. This places the banknotes accumulated in the pay-out section 4 in a collectable state, and the cashier collects the banknotes.

The banknote processing device 1 then conveys the pay-out reject banknotes stored in the temporary retention section 11 to the reject box 13B of the reject box-provided banknote cassette 13 for safekeeping.

The banknote processing device 1 performs pay-in processing and pay-out processing of banknotes in this manner.

1-3. Pay-in Section Configuration

Next, detailed explanation follows regarding configuration of the pay-in section.

Figure 3:
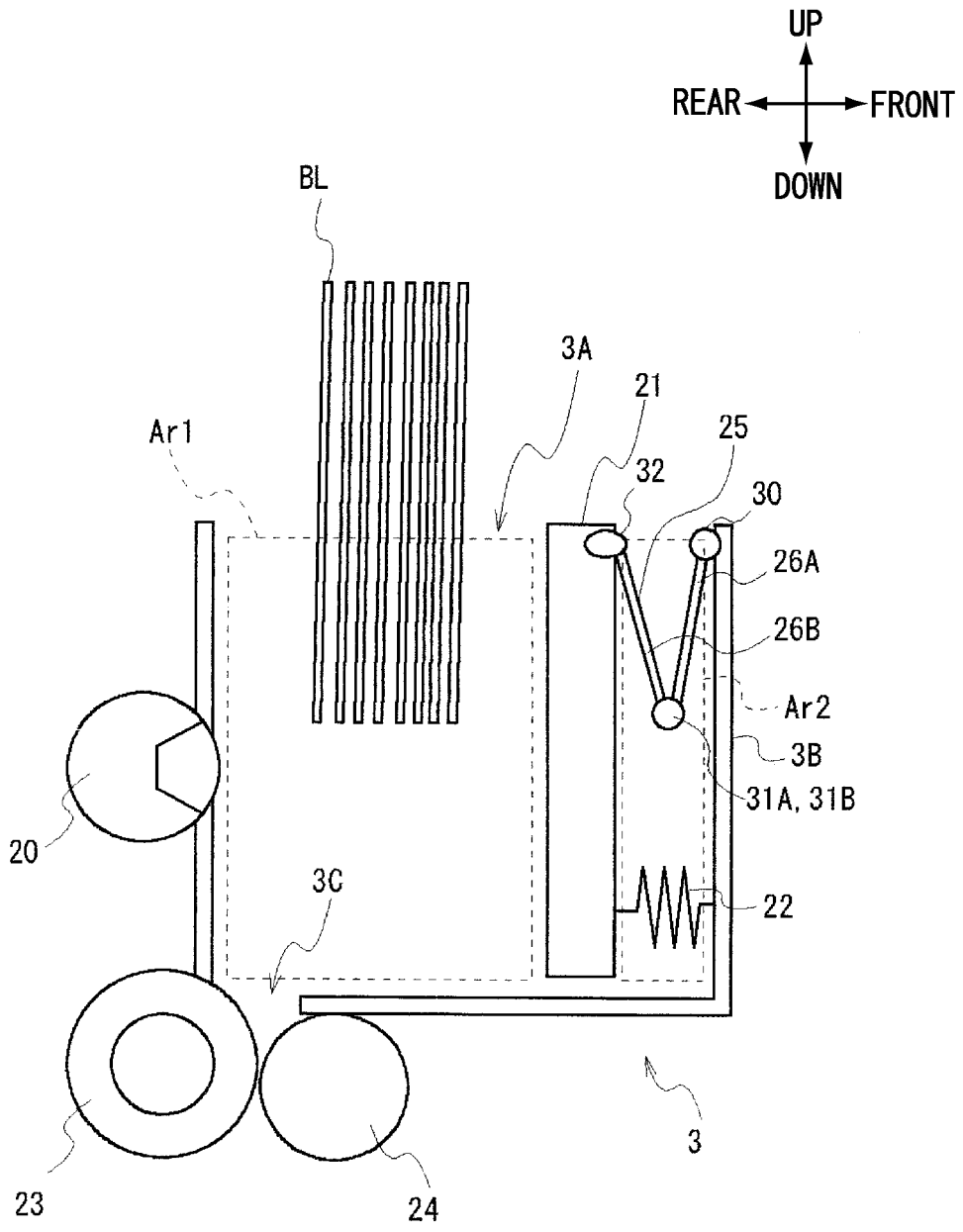
FIG. 3 is a schematic line drawing illustrating a configuration (1) of a pay-in section of a first exemplary embodiment.

As illustrated in FIG. 3, the pay-in section 3 includes the holding section 3B in the shape of a box open at an upper face. In order to simplify explanation, the pay-in section 3 is not inclined; however, in practice, the pay-in section 3 is inclined toward the front as illustrated in FIG. 2.

An intake port 3C for banknotes inserted into the holding section 3B is provided at the bottom of the holding section 3B at one end side (for example a rear end side) thereof The pay-in section 3 also includes pick-up rollers 20, of which a portion projects out from a rear wall of the holding section 3B, and a plate-shaped bill press 21 that is capable of sliding in the front-rear direction inside the holding section 3B in a state parallel to the rear wall of the holding section 3B.

Out of the overall opening provided at the upper face of the pay-in section 3, the banknote insertion port 3A is configured by the opening of a portion between the bill press 21 and the rear wall of the holding section 3B.

In the pay-in section 3, an area between the bill press 21 and the rear wall of the holding section 3B configures a banknote holding area Ar1 that holds banknotes inserted through the insertion port 3A, and an area between the bill press 21 and a front wall of the holding section 3B configures a banknote non-holding area Ar2, in which an internal mechanism 22 such as a spring is provided to slide the bill press 21.

Close underneath the intake port 3C, a feed roller 23 and a gate roller 24 are disposed facing each other along the front-rear direction.

In addition to this configuration, the pay-in section 3 also includes a folding bill press shutter 25 between the bill press 21 and the front wall of the holding section 3B.

The bill press shutter 25 is a shutter covering the banknote non-holding area Ar2 between the bill press 21 and the front wall of the holding section 3B.

Figure 4A:
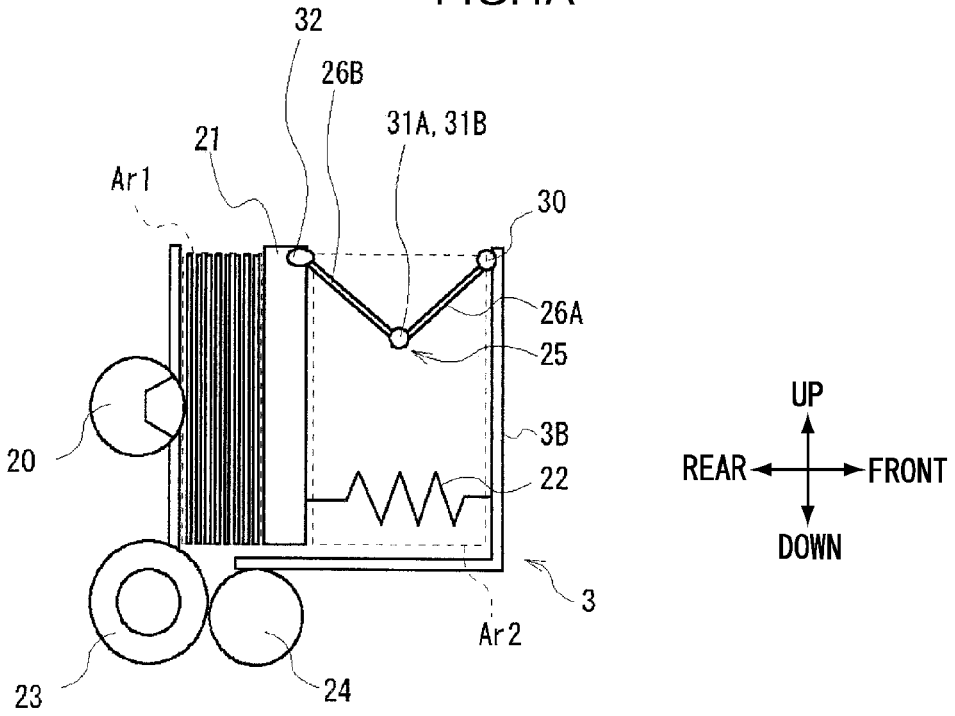
FIG. 4A is a schematic line drawing illustrating a configuration (2) of a pay-in section of the first exemplary embodiment.
Figure 4B:
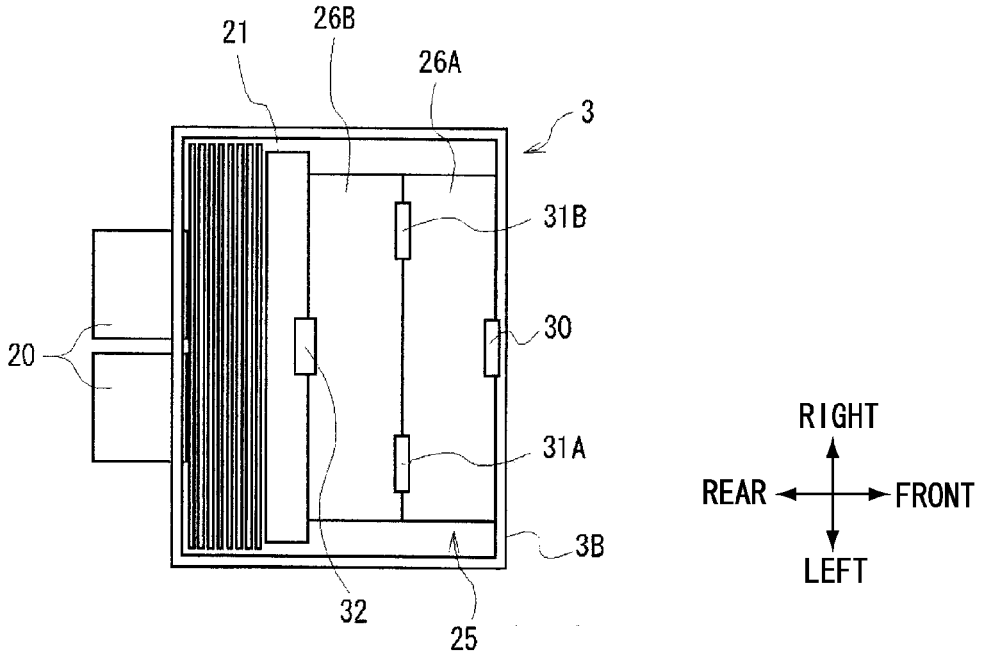
FIG. 4B is a schematic line drawing illustrating a configuration (2) of a pay-in section of the first exemplary embodiment.

As illustrated in FIG. 4A and FIG. 4B, the bill press shutter 25 has a structure including two rectangular plate-shaped members 26A and 26B with length in the left-right direction, coupled in a hinge shape in the front-rear direction. Here, the front side member 26A is referred to as the first member 26A, and the rear side member 26B is referred to as the second member 26B.

The first member 26A has a surface area roughly equivalent to the front side half of the upper face opening of the holding section 3B, and the second member 26B has a surface area roughly equivalent to the rear side half of the opening. Namely, the first member 26A and the second member 26B have sufficient surface area between the two of them to cover the upper face opening of the holding section 3B.

A central portion of a front end portion of the first member 26A is coupled to an upper end portion of the front wall of the holding section 3B through a coupling 30. A rear end portion of the first member 26A is coupled to a front end portion of the second member 26B through respective couplings 31A and 31B, at a location displaced from the center of the rear end portion by a specific interval toward the left side and a location displaced by the specific interval toward the right side.

The front end portion of the second member 26B is coupled to the rear end portion of the first member 26A through the respective couplings 31A and 31B at a location displaced from the center by a specific interval toward the left side and a location displaced by the specific interval toward the right side. A central portion of a rear end portion of the second member 26B is coupled to an upper end central portion of a back face of the bill press 21 through a coupling 32.

Figure 5A:
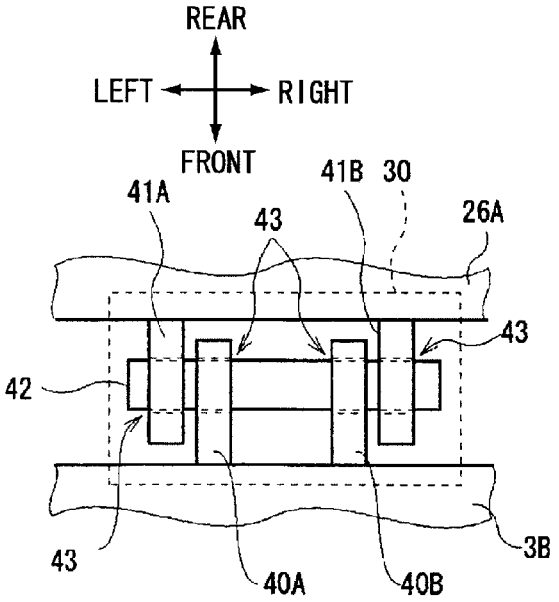
FIG. 5A is a schematic line drawing illustrating a configuration (1) of a coupling of the first exemplary embodiment.
Figure 5B:
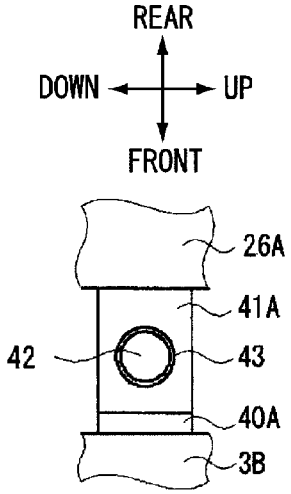
FIG. 5B is a schematic line drawing illustrating a configuration (1) of a coupling of the first exemplary embodiment.

As illustrated in FIG. 5A and FIG. 5B, the coupling 30 is configured by two plate-shaped shaft bearings 40A and 40B extending out from the front wall of the holding section 3B, two plate-shaped shaft bearings 41A and 41B extending out from a front end portion of the first member 26A, and a shaft 42.

The four shaft bearings 40A, 40B, 41A, 41B are each provided with a circular shaft hole 43 penetrating in the left-right direction, serving as holes through which the shaft 42 passes.

The interval between the two shaft bearings 41A and 41B provided on the first member 26A side is wider than the interval between the two shaft bearings 40A and 40B provided on the side of the front wall of the holding section 3B.

The shaft 42 is inserted through the shaft holes 43 of the four shaft bearings 40A, 40B, 41A, 41B to couple the first member 26A to the front wall of the holding section 3B in a state in which the two respective shaft bearings 41A and 41B provided on the first member 26A side are positioned on the outsides of the two shaft bearings 40A and 40B provided on the front wall side of the holding section 3B.

Namely, the first member 26A is coupled to the front wall of the holding section 3B so as to be freely rotatable about a rotation axis of the shaft 42 extending in the left-right direction.

The couplings 31A and 31B are configured similarly to the coupling 30, and so explanation thereof is omitted.

Figure 6A:
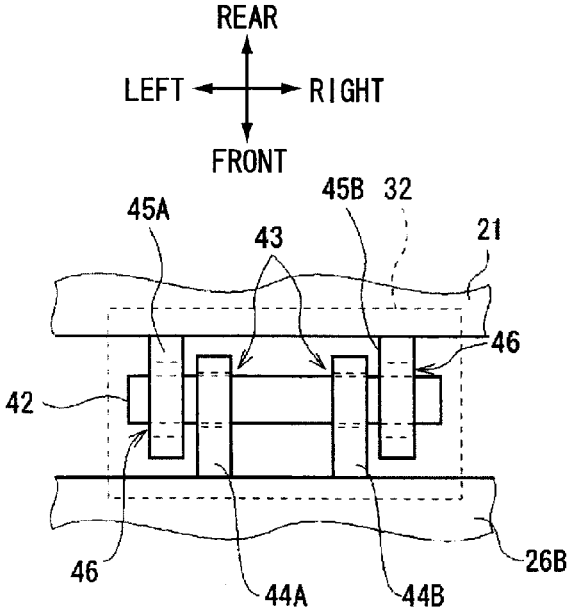
FIG. 6A is a schematic line drawing illustrating a configuration (2) of a coupling of the first exemplary embodiment.
Figure 6B:
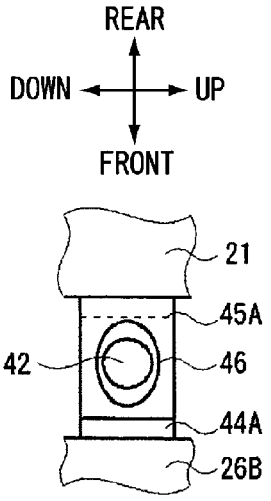
FIG. 6B is a schematic line drawing illustrating a configuration (2) of a coupling of the first exemplary embodiment.

As illustrated in FIG. 6A and FIG. 6B, the coupling 32 that couples together the bill press 21 and the second member 26B is configured by two plate-shaped shaft bearings 44A and 44B extending out from a rear end portion of the second member 26B, two plate-shaped shaft bearings 45A and 45B extending out from the back face of the bill press 21, and a shaft 42.

Out of the four shaft bearings 44A, 44B, 45A, 45B, the shaft bearings 44A, 44B provided to the second member 26B are provided with circular shaft holes 43 penetrating in the left-right direction, serving as holes through which the shaft 42 passes.

In contrast thereto, the two shaft bearings 45A, 45B provided to the bill press 21 are provided with elliptical shaft holes 46 penetrating in the left-right direction and serving as holes through which the shaft 42 passes. The elliptical, rather than circular, shape of the shaft holes 46 differs from the other couplings 30, 31A, and 31B.

The interval between the two shaft bearings 45A and 45B provided on the bill press 21 side is wider than the interval between the two shaft bearings 44A and 44B provided on the second member 26B side.

The shaft 42 is inserted through the shaft holes 43, 46 of the four shaft bearings 44A, 44B, 45A, 45B to couple the bill press 21 to the second member 26B in a state in which the two shaft bearings 45A and 45B provided on the bill press 21 are positioned on the outside of the two respective shaft bearings 44A and 44B provided on the second member 26B side.

Namely, the second member 26B is coupled to the bill press 21 so as to be freely rotatable about a rotation axis of the shaft 42 extending in the left-right direction.

In contrast to the circular cross-section of the shaft 42, the shaft holes 46 provided to the two respective shaft bearings 45A and 45B on the bill press 21 side have elliptical shapes larger than the cross-section of the shaft 42, with the major axis extending in the front-rear direction.

Namely, the shaft holes 46 provided to the two respective shaft bearings 45A and 45B on the bill press 21 side are provided with play, enabling the shaft 42 to shift in the front-rear direction as well as rotate.

Figure 7A:
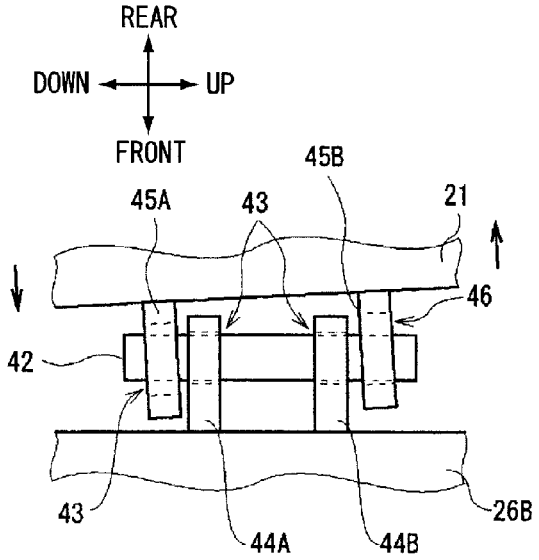
FIG. 7A is a schematic line drawing illustrating a configuration (3) of a coupling of the first exemplary embodiment.
Figure 7B:
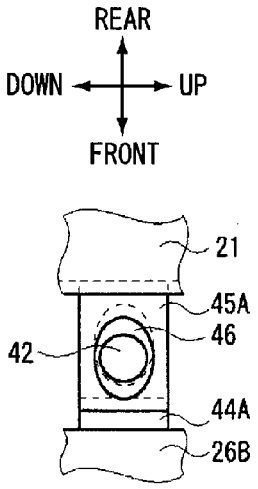
FIG. 7B is a schematic line drawing illustrating a configuration (3) of a coupling of the first exemplary embodiment.
Figure 7C:
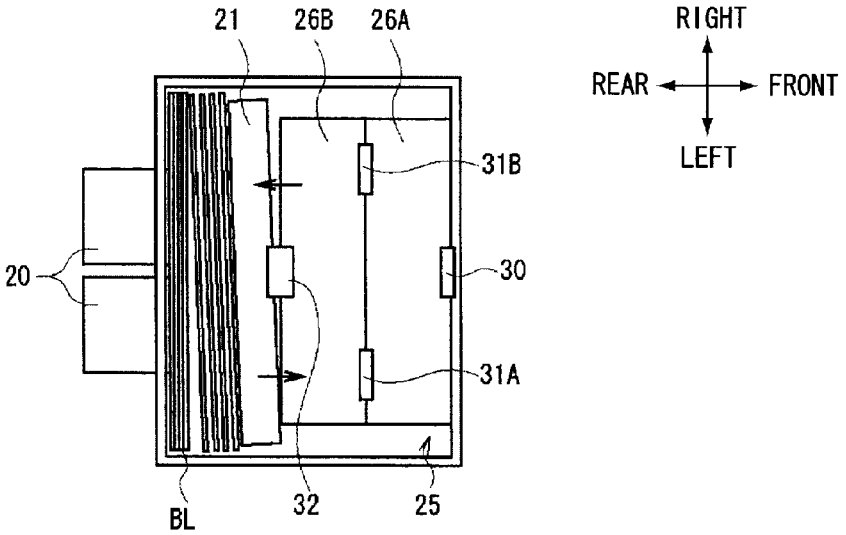
FIG. 7C is a schematic line drawing illustrating a configuration (3) of a coupling of the first exemplary embodiment.

As illustrated in FIG. 7A to FIG. 7C, the bill press 21 is thus capable of tilting from a state parallel to the wall face of the rear wall of the holding section 3B, such that the left end shifts toward the rear and the right end shifts toward the front, or in the reverse orientation thereto.

When the bill press 21 is positioned in the vicinity of the front wall of the holding section 3B, the bill press shutter 25 is closed in a folded state in which the front end of the first member 26A and the rear end of the second member 26B approach one another.

In this state, the respective couplings 31A and 31B coupling together the first member 26A and the second member 26B are positioned below the couplings 30 and 32. Namely, the bill press shutter 25 is in a state folded up into a V-shape.

When the bill press 21 slides from this state toward the rear, as illustrated in FIG. 4A, the bill press shutter 25 opens out such that the front end of the first member 26A and the rear end of the second member 26B move away from each other.

Namely, the bill press shutter 25 opens out so as to spread the opening of the V-shape.

From the folded-up state, the bill press shutter 25 accordingly opens out so as to spread toward the rear accompanying sliding of the bill press 21 toward the rear. The bill press shutter 25 thus always covers over the banknote non-holding area Ar2 between the bill press 21 and the front wall of the holding section 3B.

Next, explanation follows regarding operation of the pay-in section 3 when banknotes are paid in. As illustrated in FIG. 3, when paying in banknotes, the bill press 21 of the pay-in section 3 is positioned in the vicinity of the front wall of the holding section 3B. The position of the bill press 21 at this point is referred to as the initial position.

At this point, the bill press shutter 25 is housed in a folded state (folded-up position) between the bill press 21 and the front wall of the holding section 3B.

Namely at this point, in the pay-in section 3, the banknote holding area Ar1 between the bill press 21 and the rear wall of the holding section 3B is in its widest state, enabling the cashier to easily recognize that banknotes should be inserted into the banknote holding area Ar1 through the insertion port 3A.

The cashier then inserts banknotes BL through the insertion port 3A into the banknote holding area Ar1 between the bill press 21 and the rear wall of the holding section 3B.

Once this has been performed, the pay-in section 3 slides the bill press 21 so as to approach the rear wall of the holding section 3B.

When the bill press 21 is slid in this manner, the banknote holding area Ar1 between the bill press 21 and the rear wall of the holding section 3B becomes narrower, while the banknote non-holding area Ar2 between the bill press 21 and the front wall of the holding section 3B widens.

At this point, as illustrated in FIG. 4A, the bill press shutter 25 opens out while covering over the banknote non-holding area Ar2 (in an open position), such that the banknote non-holding area Ar2 is always in a state closed off by the bill press shutter 25.

The cashier can thus be prevented from mistakenly inserting banknotes into the banknote non-holding area Ar2, and the entry of foreign objects other than banknotes into the banknote non-holding area Ar2 can also be prevented.

The pay-in section 3 then slides the bill press 21 further, and the bill press 21 presses the banknotes against the pick-up rollers 20.

The pay-in section 3 thus nips the banknotes between the bill press 21 and the pick-up rollers 20.

Note that as illustrated in FIG. 7C, the bill press 21 is capable of tilting from a state parallel to the wall face (also referred to as the press face) of the rear wall of the holding section 3B, such that the left end shifts toward the rear and the right end shifts toward the front, or the reverse orientation thereto. Namely, the bill press 21 is capable of tilting with respect to the press face of the rear wall of the holding section 3B.

This enables the orientation to tilt according to differences arising when there is a left-right difference in the thickness of a bundle of banknotes due to, for example, differences in the type, or state, of the inserted banknotes. This thereby enables the bundle of banknotes to be more reliably nipped by the pick-up rollers 20.

In other words, the banknotes can be more reliably pressed against the pick-up rollers 20.

Note that the banknotes pressed against the pick-up rollers 20 are separated and fed downwards toward the intake port 3C one note at a time by rotation of the pick-up rollers 20. The banknotes are then taken inside the banknote processing device 1 through the intake port 3C by the feed roller 23 and the gate roller 24.

In this manner, the banknote processing device 1 takes in pay-in banknotes from the pay-in section 3 one note at a time.

Once all of the banknotes have been taken in, the pay-in section 3 slides the bill press 21 forward to be returned to the original position (the initial position). When this is performed, the bill press shutter 25 is folded up again, and is housed between the bill press 21 and the front wall of the holding section 3B.

1-4. Advantageous Effects

In the above configuration, the banknote processing device 1 includes the bill press shutter 25 that opens out between the bill press 21 and the front wall of the holding section 3B so as to cover the banknote non-holding area Ar2 between the bill press 21 and the front wall of the holding section 3B accompanying sliding of the bill press 21 toward the rear wall side of the holding section 3B.

So doing enables the banknote non-holding area Ar2 that widens accompanying sliding of the bill press 21 toward the rear to be closed off by the bill press shutter 25 during pay-in.

In the banknote processing device 1, during pay-in, the cashier is able to recognize that banknotes are not to be inserted into the banknote non-holding area Ar2, and mistaken insertion of banknotes into the banknote non-holding area Ar2 by the cashier, as well as the entry of foreign objects other than banknotes into the banknote non-holding area Ar2, can be prevented.

The bill press shutter 25 is coupled to an upper end portion of the back face of the bill press 21 and an upper end portion of the front wall of the holding section 3B, such that the bill press shutter 25 opens out from the folded state using the sliding force of the bill press 21.

The banknote processing device 1 can accordingly prevent mistaken insertion of banknotes into the banknote non-holding area Ar2 with a simple configuration, without separately providing extensive additional mechanisms such as an electric shutter, and without requiring complex control.

The coupling 32 between the bill press 21 and the bill press shutter 25 is provided with play to enabling tilting of the bill press 21 with respect to the press face of the rear wall of the holding section 3B.

The bill press 21 can therefore tilt according to differences in the thickness of a banknote bundle when a bundle of banknotes with thickness that differs from left to right is nipped between the bill press 21 and the pick-up rollers 20 provided at the press face of the holding section 3B. This thereby enables a banknote bundle with thickness that differs from left to right to be reliably nipped between the bill press 21 and the pick-up rollers 20.

Providing play between the bill press 21 and the coupling 32 enables the bill press shutter 25 to open out smoothly toward the rear, without being affected by tilting of the bill press 21.

The above configuration of the banknote processing device 1 enables the cashier to recognize that banknotes are not to be inserted into the banknote non-holding area Ar2 without separately providing an extensive mechanism such as an electric shutter, enables mistaken media insertion into the banknote non-holding area Ar2 to be prevented, and enables incorrect banknote insertion to be prevented with a simple configuration.

2. Second Exemplary Embodiment

Next, explanation follows regarding a second exemplary embodiment. The second exemplary embodiment is an exemplary embodiment in which the configuration of the pay-in section differs from that of the first exemplary embodiment. Explanation is therefore only given regarding the configuration of the pay-in section.

2-1. Pay-in Section Configuration

Figure 8:
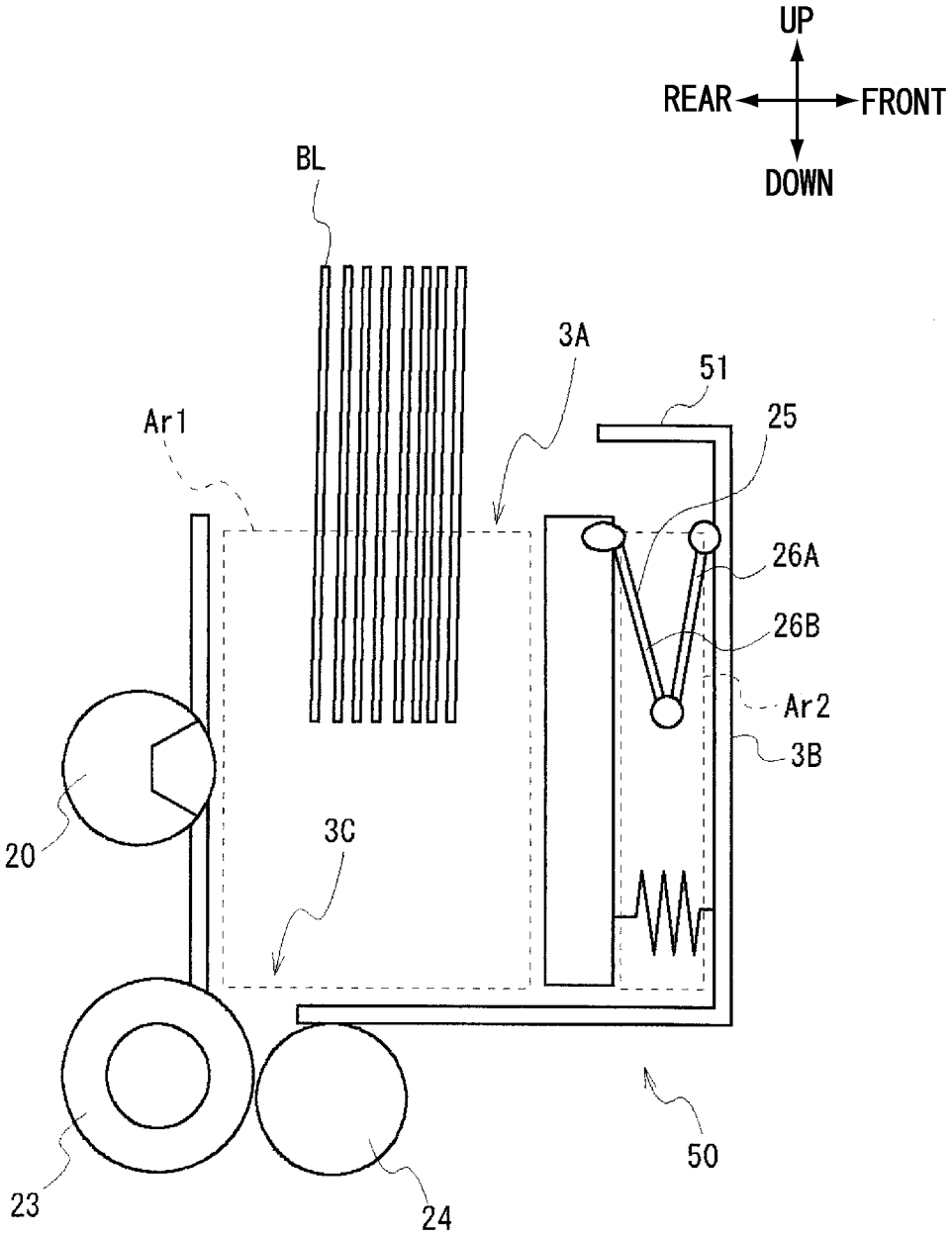
FIG. 8 is a schematic line drawing illustrating a configuration a pay-in section of a second exemplary embodiment.

FIG. 8 illustrates a pay-in section 50 of a second exemplary embodiment. In FIG. 8, portions similar to those of the pay-in section 3 of the first exemplary embodiment are allocated the same reference numerals thereto.

The pay-in section 50 of the second exemplary embodiment includes a cover 51 covering a front end portion of the opening provided at the upper face of the holding section 3B.

The cover 51 covers over a gap (namely the banknote non-holding area Ar2) between the bill press 21 and the front wall of the holding section 3B when the bill press 21 is positioned in the vicinity of the front wall of the holding section 3B, namely when in the initial position.

The cover 51 may be integrally molded to the holding section 3B, or may be attached to the holding section 3B as a separate component to the holding section 3B.

In practice, when the bill press 21 is positioned in the vicinity of the front wall of the holding section, the bill press shutter 25 is folded up into a V-shape, such that the bill press shutter 25 itself forms a recess.

When the bill press shutter 25 itself forms such a recess, it is conceivable that the cashier may mistakenly insert banknotes into the recess rather than the insertion port 3A, or that foreign objects may enter the recess.

In the second exemplary embodiment, the cover 51 is therefore provided to cover the front end portion of the opening provided at the upper face of the holding section 3B.

Namely, the cover 51 is provided to cover a portion between the bill press and the front wall of the holding section 3B when the bill press 21 is in the initial position.

Accordingly, when the bill press shutter 25 is folded up, the cover 51 is positioned above the bill press shutter 25, such that the folded bill press shutter 25 is covered by the cover 51.

The cover 51 thereby also covers the recess formed by the folded bill press shutter 25, enabling mistaken insertion of banknotes into the recess by the cashier, and the entry of foreign objects other than banknotes, to be prevented.

Were the cover 51 to be provided covering the entire opening provided at the upper face of the holding section 3B, the insertion port 3A would obviously be closed off as well, preventing banknotes from being inserted. Accordingly, covering only the front end portion of the opening avoids obstructing banknote insertion.

3. Other Exemplary Embodiments 3-1. Other Exemplary Embodiment 1

In the first and second exemplary embodiments described above, the pay-in section 3 is provided with the folding bill press shutter 25 in which the plate-shaped first member 26A and second member 26B are coupled together.

There is no limitation thereto, and shutters other than the bill press shutter 25 may be employed, provided that they serve a similar function to the bill press shutter 25.

Figure 9A:
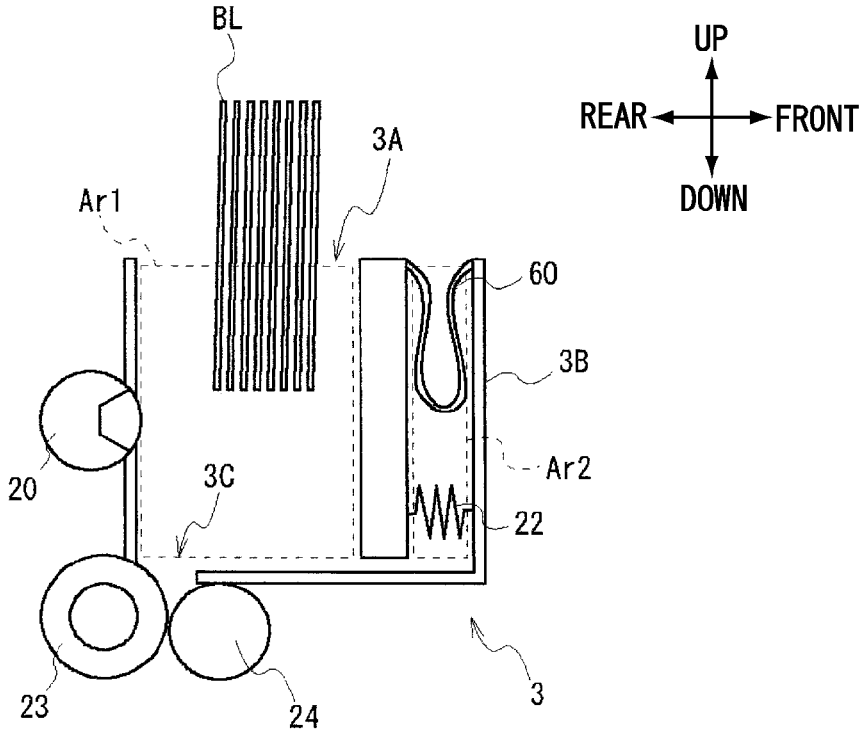
FIG. 9A is a schematic line drawing illustrating a configuration (1) of a pay-in section of another exemplary embodiment.
Figure 9B:
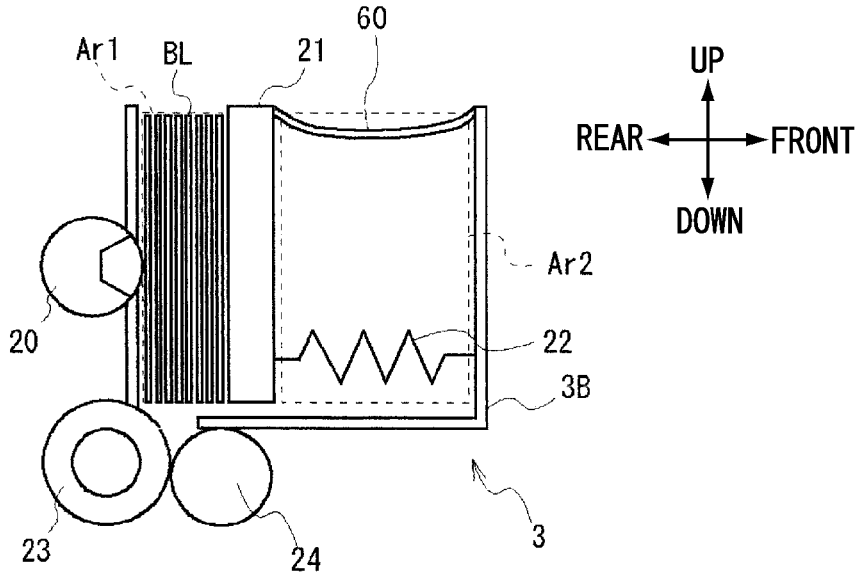
FIG. 9B is a schematic line drawing illustrating a configuration (1) of a pay-in section of another exemplary embodiment.

For example, as illustrated in FIG. 9A and FIG. 9B, the pay-in section 3 may be provided with a bill press shutter 60 made from a thin film material instead of the folding bill press shutter 25.

The film material bill press shutter 60 has a quadrilateral shape with a surface area roughly equivalent to that of the opening at the upper face of the holding section 3B.

A front end portion of the bill press shutter 60 is fixed to the upper end portion of the front wall of the holding section 3B. A rear end portion of the bill press shutter 60 is fixed to the upper end portion of the back face of the bill press 21.

The bill press shutter 60 warps in a downward-hanging folded-up state when the bill press 21 is positioned in the vicinity of the front wall of the holding section 3B.

When the bill press 21 slides toward the rear from this state, the bill press shutter 60 opens out correspondingly so as to spread toward the rear.

The bill press shutter 60 accordingly covers over the banknote non-holding area Ar2 between the bill press 21 and the front wall of the holding section 3B, opening out from the folded state so as to spread toward the rear, accompanying sliding of the bill press 21 toward the rear.

The cashier can accordingly be prevented from mistakenly inserting banknotes into the banknote non-holding area Ar2, and the entry of foreign objects other than banknotes into the banknote non-holding area Ar2 can also be prevented.

Then, for example, after completion of banknote pay-in, the bill press shutter 60 returns to its folded state accompanying sliding of the bill press 21 returning to the initial position.

Rather than being folded up and housed inside the holding section 3B, such a film bill press shutter 60 may be housed in a space outside the holding section 3B, and pulled into the holding section 3B from outside the holding section 3B accompanying sliding of the bill press 21.

Figure 10A:
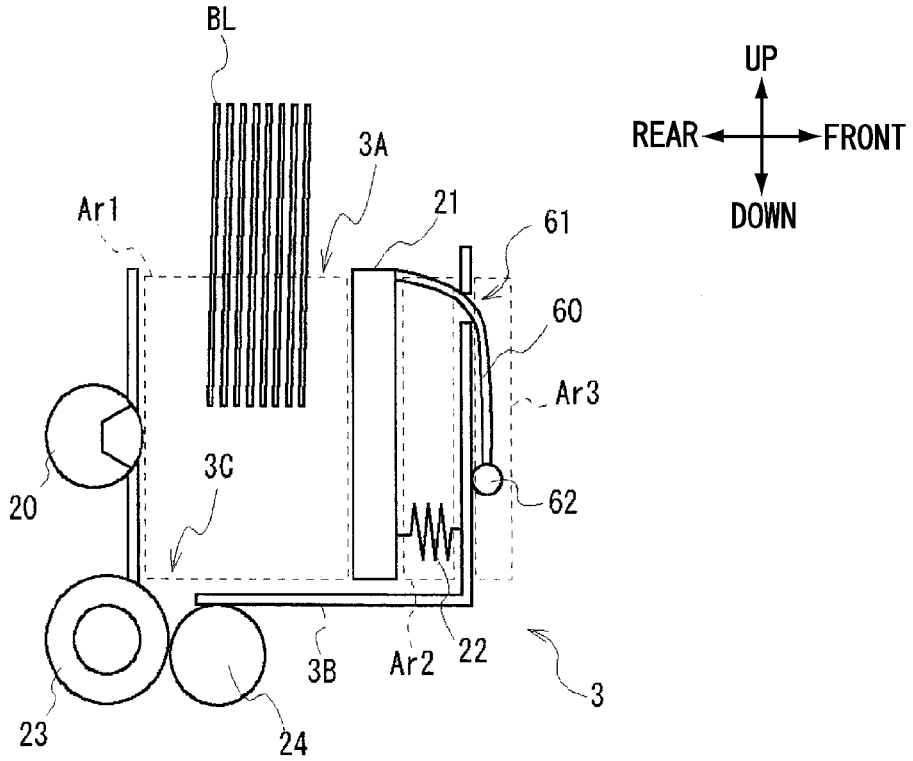
FIG. 10A is a schematic line drawing illustrating a configuration (2) of a pay-in section of another exemplary embodiment.
Figure 10B:
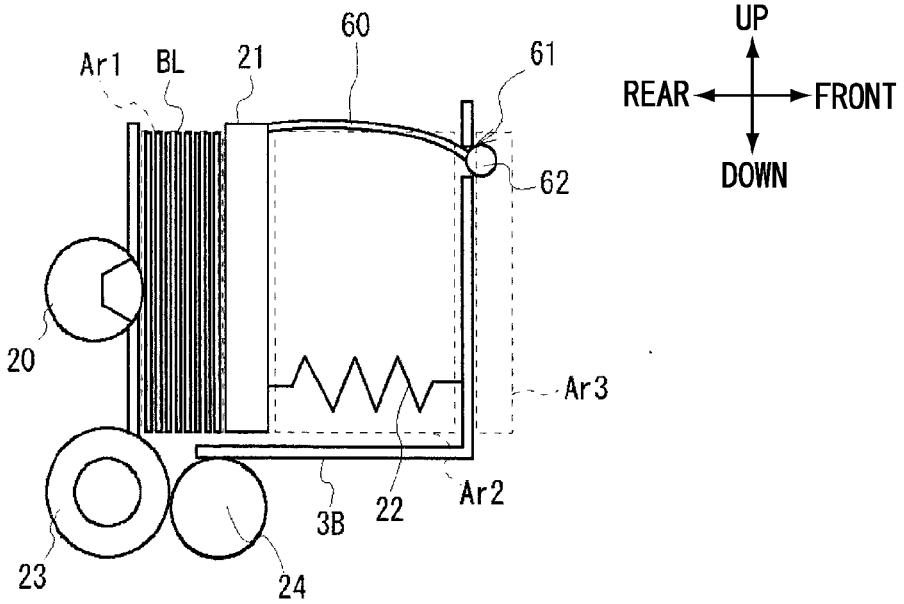
FIG. 10B is a schematic line drawing illustrating a configuration (2) of a pay-in section of another exemplary embodiment.

FIG. 10A and FIG. 10B illustrate an example of such a configuration. The pay-in section 3 is provided with a hole 61 through which the bill press shutter 60 passes at an upper end portion of the front wall of the holding section 3B. The hole 61 is in communication with a shutter housing section Ar3 provided outside the holding section 3B. The shutter housing section Ar3 is provided inside the banknote processing device 1.

The bill press shutter 60 passes through the hole 61 provided to the holding section 3B. A front end portion of the bill press shutter 60 is positioned outside the holding section 3B and a rear end portion of the bill press shutter 60 is positioned inside the holding section 3B.

The rear end portion of the bill press shutter 60 is fixed to the upper end portion of the back face of the bill press 21. The front end portion of the bill press shutter 60 is attached to a stopper 62 that is larger than the hole 61 provided to the holding section 3B.

The stopper 62 is, for example, a metal ball of a specific weight. The stopper 62 not only prevents the front end portion of the bill press shutter 60 from passing through the hole 61 and entering the holding section 3B, but the weight of the stopper 62 also pulls the front end portion of the bill press shutter 60 downward.

When the bill press 21 is positioned in the vicinity of the front wall of the holding section 3B, substantially the entire bill press shutter 60 has passed outside through the hole 61 provided to the front wall of the holding section 3B and is in a housed state in the shutter housing section Ar3.

When the bill press 21 slides from this state toward the rear, the bill press shutter 60 is pulled by the bill press 21, and is pulled out inside the holding section 3B through the hole 61 provided to the front wall of the holding section 3B.

The bill press shutter 60 accordingly passes from the shutter housing section Ar3 provided outside the holding section 3B, through the hole 61 provided to the front wall of the holding section 3B, and is pulled out inside the holding section 3B accompanying sliding of the bill press 21 to the rear, such that the banknote non-holding area Ar2 between the bill press 21 and the front wall of the holding section 3B is always covered over.

The cashier can thus be prevented from mistakenly inserting banknotes into the banknote non-holding area Ar2, and the entry foreign objects other than banknotes into the banknote non-holding area Ar2 can also be prevented.

Then, for example when banknote pay-in has been completed and the bill press 21 slides to return to the initial position, the front end portion of the bill press shutter 60 is pulled downward by the weight of the stopper 62, such that the bill press shutter 60 passes through the hole 61 provided to the front wall of the holding section 3B and is housed in the shutter housing section Ar3.

Figure 11A:
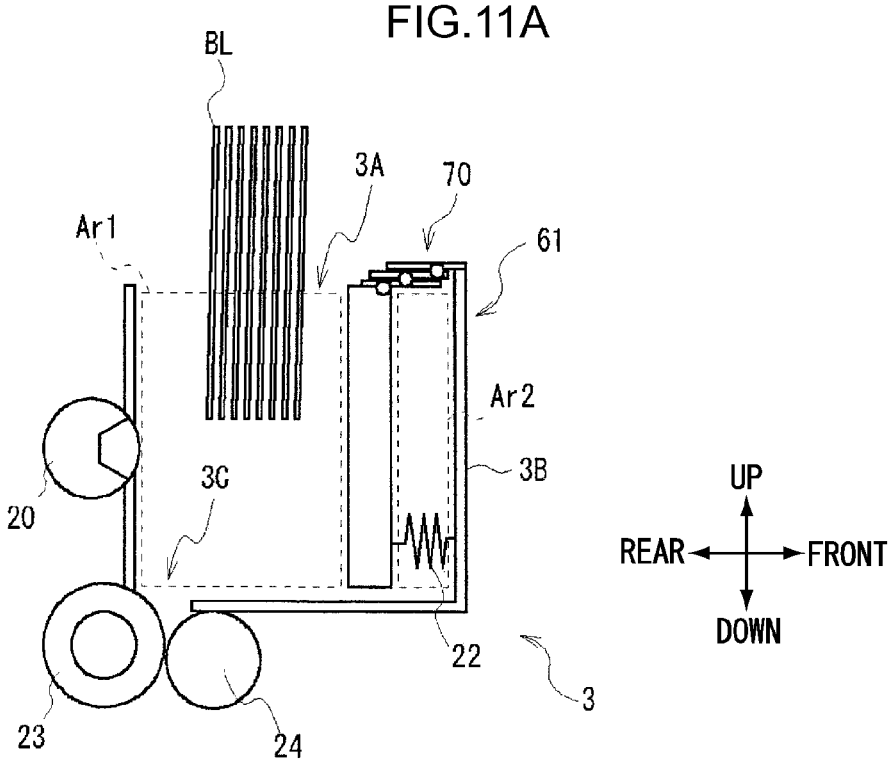
FIG. 11A is a schematic line drawing illustrating a configuration (3) of a pay-in section of another exemplary embodiment.
Figure 11B:
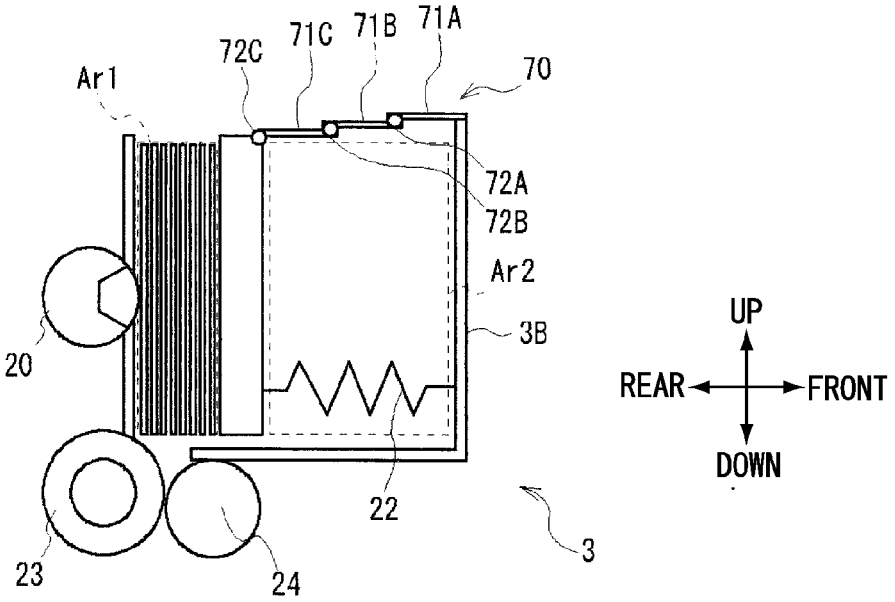
FIG. 11B is a schematic line drawing illustrating a configuration (3) of a pay-in section of another exemplary embodiment.

As another example, as illustrated in FIG. 11A and FIG. 11B, the pay-in section 3 may be provided with a sliding bill press shutter 70 in which plural plate-shaped members slide in the front-rear direction in place of the folding bill press shutter 25.

The bill press shutter 70 has a structure in which, for example, three rectangular plate-shaped members 71A, 71B, 71C are coupled in the up-down direction. Here, the uppermost member 71A is referred to as the first member 71A, the member 71B in the middle is referred to as the second member 71B, and the lowermost member 71C is referred to as the third member 71C.

The first member 71A, the second member 71B, and the third member 71C each have a surface area of approximately one third of the opening at the upper face of the holding section 3B. Namely, the first member 71A, the second member 71B, and the third member 71C have a sufficient surface area between the three of them to cover the opening at the upper face of the holding section 3B.

A front end portion of the first member 71A is fixed to an upper end portion of the front wall of the holding section 3B. The second member 71B positioned below the first member 71A is coupled to the first member 71A through a coupling 72A so as to be slidable in the front-rear direction.

The third member 71C positioned below the second member 71B is coupled to the second member 71B through a coupling 72B so as to be slidable in the front-rear direction.

The upper end portion of the bill press 21 is positioned below the third member 71C, and the third member 71C is coupled to the upper end portion of the bill press 21 through a coupling 72C so as to be slidable in the front-rear direction.

When the bill press 21 is positioned in the vicinity of the front wall of the holding section 3B, the bill press shutter 70 is in an overlapping folded state in which the second member 71B is positioned below the first member 71A, the third member 71C is positioned below the second member 71B, and the bill press 21 is positioned below the third member 71C in a layered arrangement.

When the bill press 21 slides from this state toward the rear, the bill press shutter 70 correspondingly opens out such that the respective second member 71B and third member 71C slide toward the rear.

The bill press shutter 70 thus opens out from the top-to-bottom overlapping folded state to spread toward the rear accompanying sliding of the bill press 21 toward the rear, and the banknote non-holding area Ar2 between the bill press 21 and the front wall of the holding section 3B is always covered over.

The cashier can thus be prevented from mistakenly inserting banknotes into the banknote non-holding area Ar2, and the entry foreign objects other than banknotes into the banknote non-holding area Ar2 can also be prevented.

The bill press shutter 70 does not form a recess in the folded state, and so there is no need to provide the cover 51 described above, enabling a commensurate simplification in configuration.

Any configuration allowing slidable coupling of the respective members 71 (71A to 71C) in the front-rear direction may be employed for the respective couplings 72 (72A to 72C).

For example, the coupling 72A may be configured by a front-rear direction groove provided to the upper side first member 71A, and a ridge protruding from the upper face of the lower side second member 71B.

The upper side first member 71A and the lower side second member 71B are then coupled together by slidably fitting together the ridge provided to the lower side second member 71B and the groove provided to the upper side first member 71A. In such a configuration, the ridge is, for example, provided with a T-shaped cross-section so as not to come out of the groove. Similar configuration is employed for the other couplings 72B, 72C.

There is no limitation to the bill press shutters 60 and 70 described above, and bill press shutters employing other mechanisms thereto may be employed.

Figure 12A:
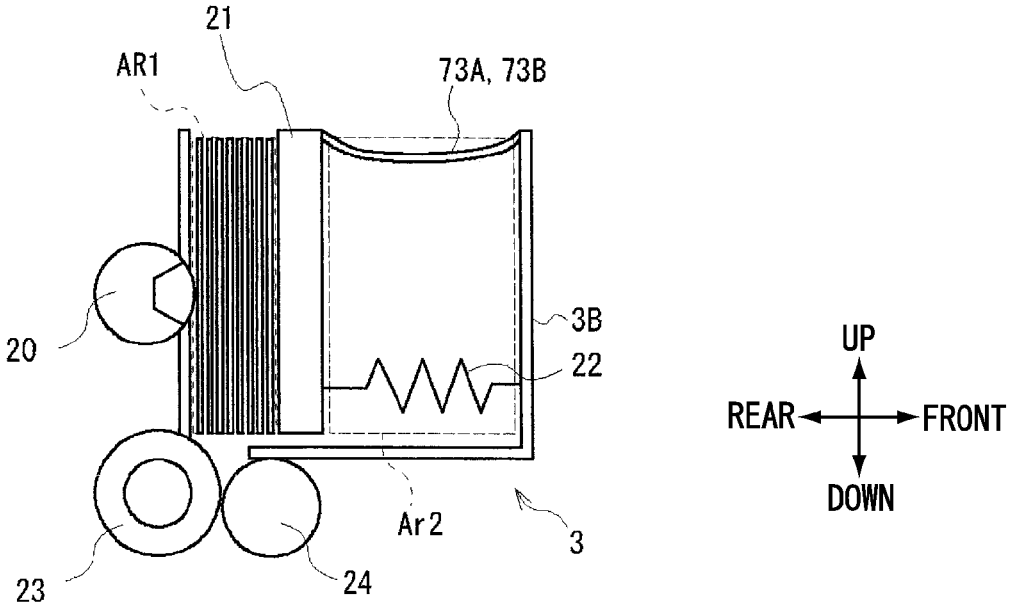
FIG. 12A is a schematic line drawing illustrating a configuration (4) of a pay-in section of another exemplary embodiment.
Figure 12B:
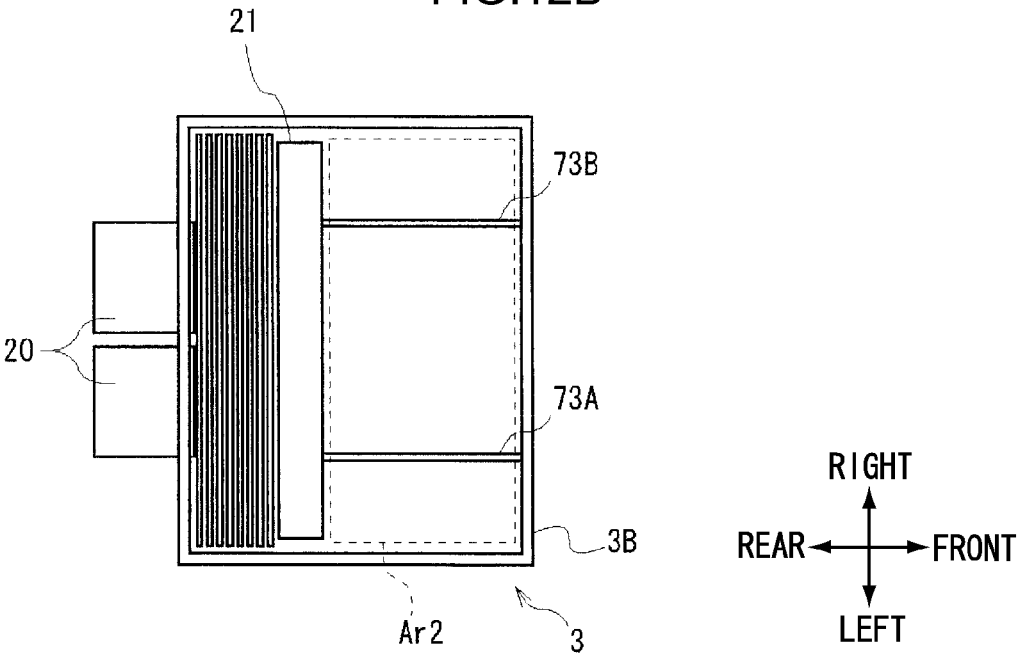
FIG. 12B is a schematic line drawing illustrating a configuration (4) of a pay-in section of another exemplary embodiment.

As illustrated in FIG. 12A and FIG. 12B, one or plural cord members 73 (73A, 73B) may span between an upper end portion of the bill press 21 and an upper end portion of the front wall of the holding section 3B in place of the bill press shutter 25.

In such a configuration, the banknote non-holding area Ar2 is not covered over as with the bill press shutter 25, however the cord members 73 spanning across still enable the cashier to recognize that banknotes are not to be inserted into the banknote non-holding area Ar2, enabling a reduction in mistaken banknote insertion.

3-2. Other Exemplary Embodiment 2

In the first exemplary embodiment described above, the pay-in section 3 is provided with the bill press shutter 25 that folds up into a V-shape.

As described above, the bill press shutter 25 forms a recess in which the bill press shutter 25 itself dips downwards when folded.

Figure 13:
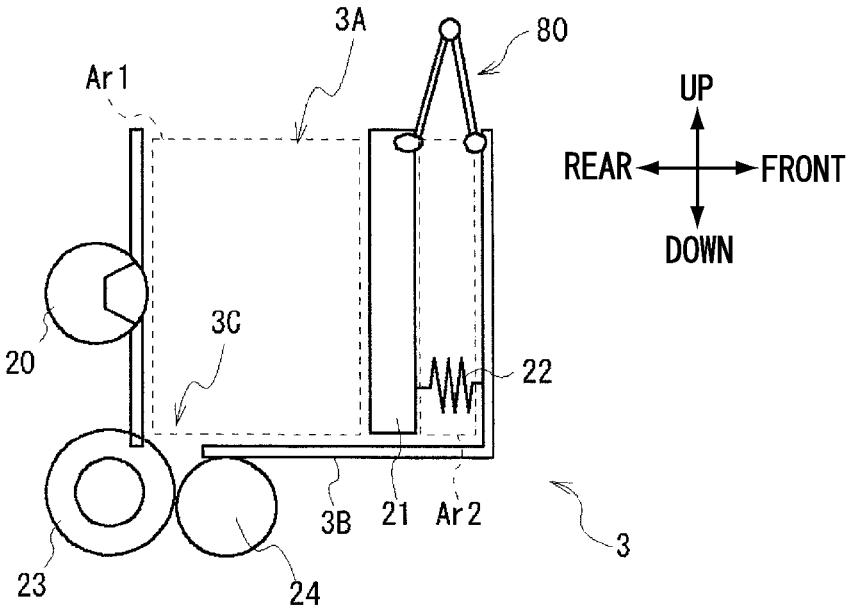
FIG. 13 is a schematic line drawing illustrating a configuration (5) of a pay-in section of another exemplary embodiment.

As illustrated in FIG. 13, a reverse V-shape bill press shutter 80 that projects upwards when folded may be provided in place of the bill press shutter 25.

Such a configuration enables the issues arising with the V-shaped bill press shutter 25 to be resolved, since the bill press shutter 80 does not form a recess when folded.

Figure 14:
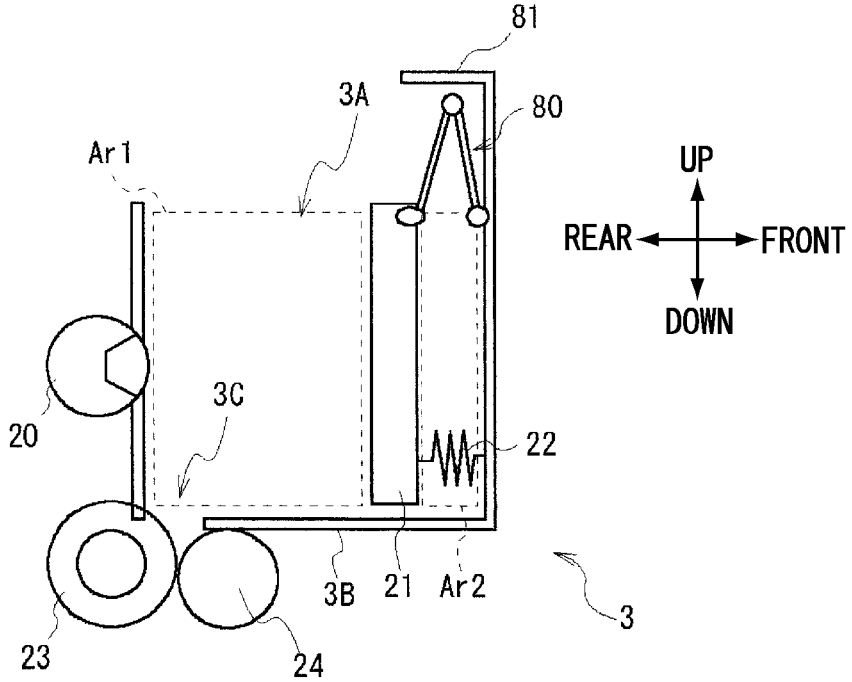
FIG. 14 is a schematic line drawing illustrating a configuration (6) of a pay-in section of another exemplary embodiment.

As illustrated in FIG. 14, a cover 81 may be provided to a front end portion of the upper end of the holding section 3B so as to cover the bill press shutter 80 when folded.

3-3. Other Exemplary Embodiment 3

In the first exemplary embodiment described above, the pay-in section 3 is provided with the bill press shutter 25 in which the two same-sized members of the first member 26A and second member 26B are coupled together.

Figure 15A:
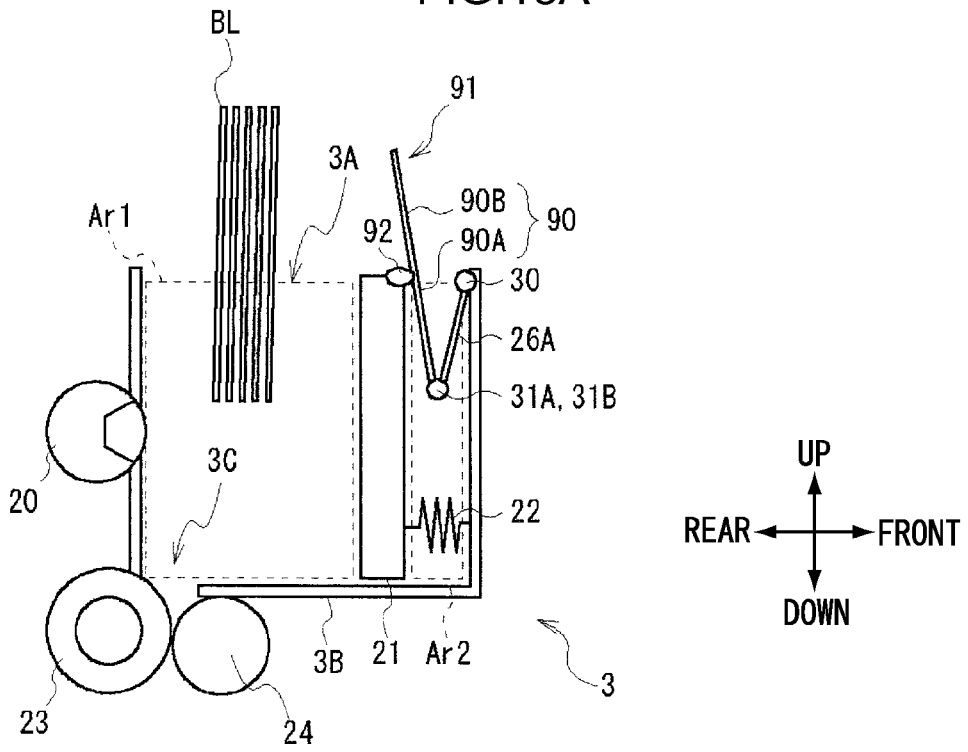
FIG. 15A is a schematic line drawing illustrating a configuration (7) of a pay-in section of another exemplary embodiment.
Figure 15B:
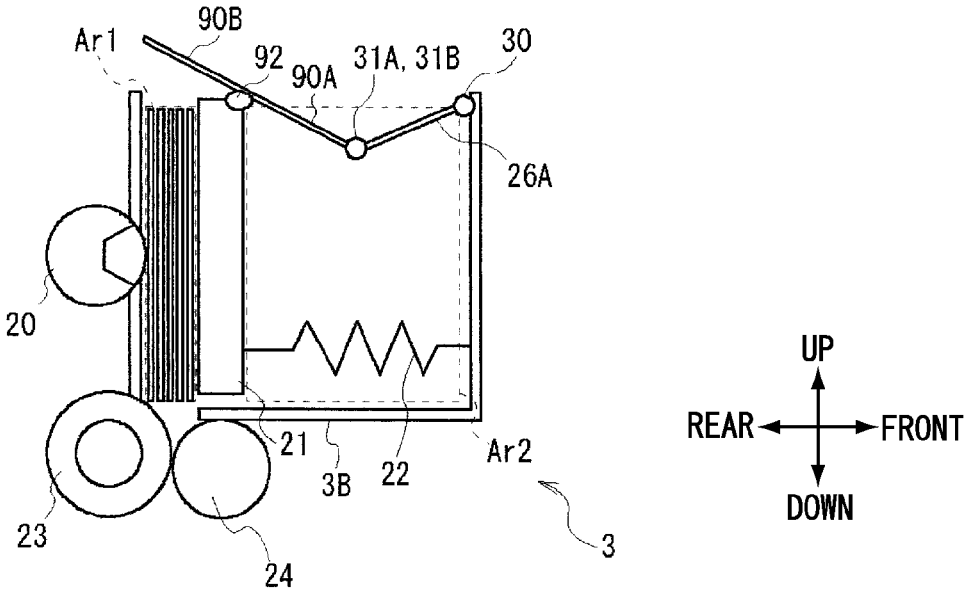
FIG. 15B is a schematic line drawing illustrating a configuration (7) of a pay-in section of another exemplary embodiment.
Figure 16:
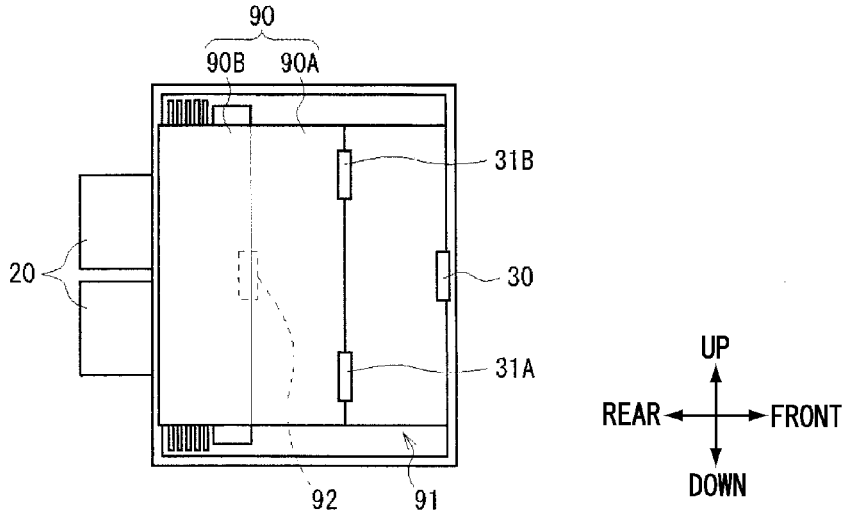
FIG. 16 is a schematic line drawing illustrating a configuration (8) of a pay-in section of another exemplary embodiment.

There is no limitation thereto, and for example, as illustrated in FIG. 15A, FIG. 15B and FIG. 16, a bill press shutter 91 may be configured by coupling together the first member 26A and a second member 90 that is longer than (for example approximately twice as long as) the first member 26A in the front-rear direction.

In order to simplify explanation, the second member 90 is divided into a front portion 90A of the same size as the first member 26A, and a rear portion 90B.

Namely, the second member 90 is longer than the first member 26A in the front-rear direction by the length of the rear portion 90B.

A front end portion of the front portion 90A of the second member 90 is coupled to a rear end portion of the first member 26A through couplings 31A and 31B. A boundary portion of the second member between the front portion 90A and the rear portion 90B is coupled to an upper end central portion of the back face of the bill press 21 through a coupling 92.

Figure 17A:
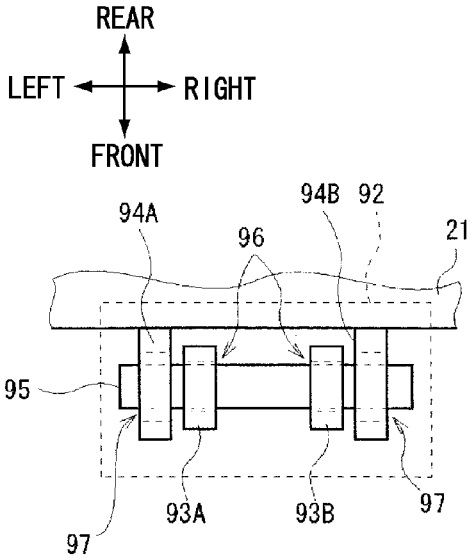
FIG. 17A is a schematic line drawing illustrating a configuration of a coupling of another exemplary embodiment.
Figure 17B:
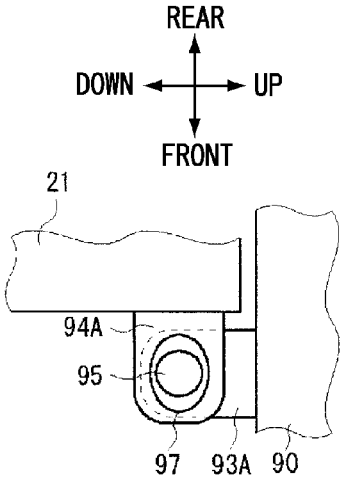
FIG. 17B is a schematic line drawing illustrating a configuration of a coupling of another exemplary embodiment.

As illustrated in FIG. 17A and FIG. 17B, the coupling 92 is, for example, configured by two plate-shaped shaft bearings 93A and 93B extending out from a lower face of the second member 90, two plate-shaped shaft bearings 94A and 94B extending out from the back face of the bill press 21, and a shaft 95.

Out of the four shaft bearings 93A, 93B, 94A, 94B, the shaft bearings 93A, 93B provided to the second member 90 are provided with circular shaft holes 96 penetrating in the left-right direction, serving as holes through which the shaft 95 passes.

In contrast thereto, the shaft bearings 94A, 94B provided to the bill press 21 are provided with elliptical shaft holes 97 penetrating in the left-right direction, serving as holes through which the shaft 95 penetrates. The shaft holes 97 are configured with elliptical holes so as to allow the bill press 21 to tilt, similarly to in the first exemplary embodiment.

The interval between the two shaft bearings 94A, 94B provided on the bill press 21 side is wider than the interval between the two shaft bearings 93A, 93B provided on the second member 90 side.

The bill press 21 and the second member 90 are coupled together by inserting the shaft 95 through the shaft holes 96, 97 in the four shaft bearings 93A, 93B, 94A, 94B in a state in which the two shaft bearings 94A, 94B provided on the bill press 21 side are positioned on the outside of the two shaft bearings 93A, 93B provided on the second member 90 side.

Namely, the second member 90 is coupled to the bill press 21 so as to be freely rotatable about a rotation axis of the shaft 95 extending in the left-right direction.

When the bill press 21 is positioned in the vicinity of the front wall of the holding section 3B, the bill press shutter 91 is in a folded-up state in which the front end of the first member 26A and the rear end of the second member 90 approach each other. At this point, the rear portion 90B of the second member 90 projects out above the upper end portion of the bill press 21.

When the bill press 21 slides from this state toward the rear, the bill press shutter 91 opens out such that the front end of the first member 26A and the rear end of the second member 90 move away from each other.

Namely, the bill press shutter 91 opens out so as to spread the opening of the V-shape.

From the folded-up state, the bill press shutter 91 accordingly opens out so as to spread toward the rear accompanying sliding of the bill press 21 toward the rear. The bill press shutter 91 thus always covers over the banknote non-holding area Ar2 between the bill press 21 and the front wall of the holding section 3B.

When the bill press 21 approaches the rear wall of the holding section 3B, the rear portion 90B of the second member 90 of the bill press shutter 91 also projects out to the rear of the bill press 21.

At this point, the portion projecting out to the rear of the bill press 21, namely the rear portion of the second member 90, covers over the opening at a portion between the bill press 21 and the rear wall of the holding section 3B, namely over the insertion port 3A.

So doing enables the bill press shutter 91 to cover not only the banknote non-holding area Ar2, but also to close off the insertion port 3A when the inserted banknotes are pressed against the pick-up rollers 20 by the bill press 21 and the banknotes are taken in one note at a time, thereby enabling the banknotes to be taken in correctly.

Figure 18:
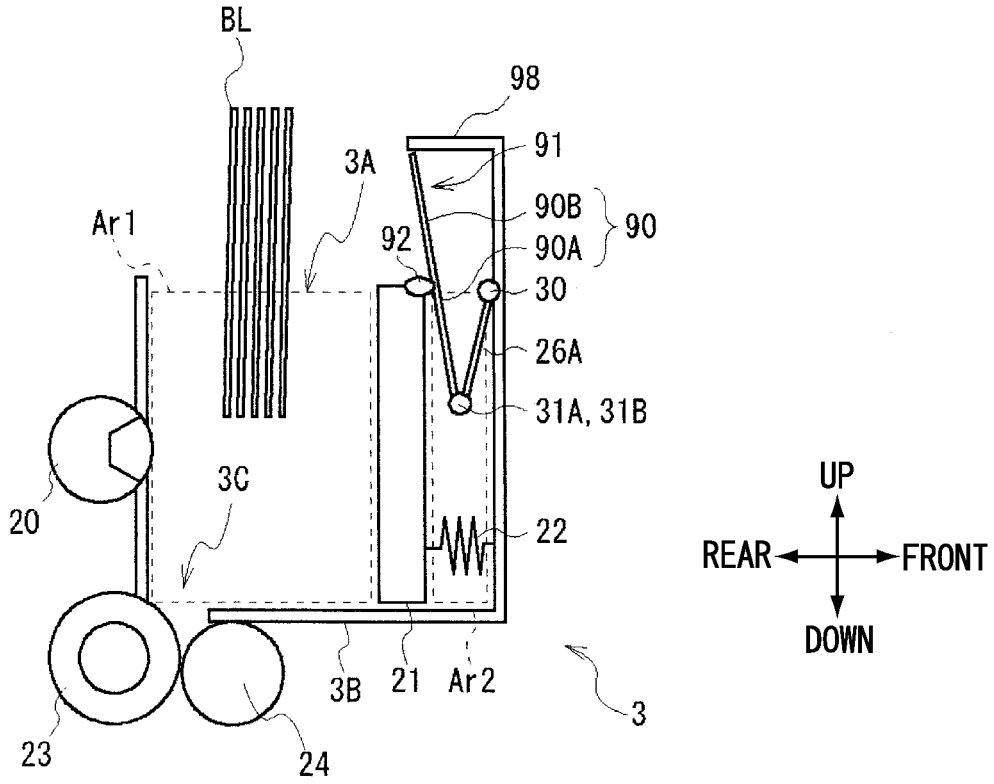
FIG. 18 is a schematic line drawing illustrating a configuration (9) of a pay-in section of another exemplary embodiment.
Figure 19A:
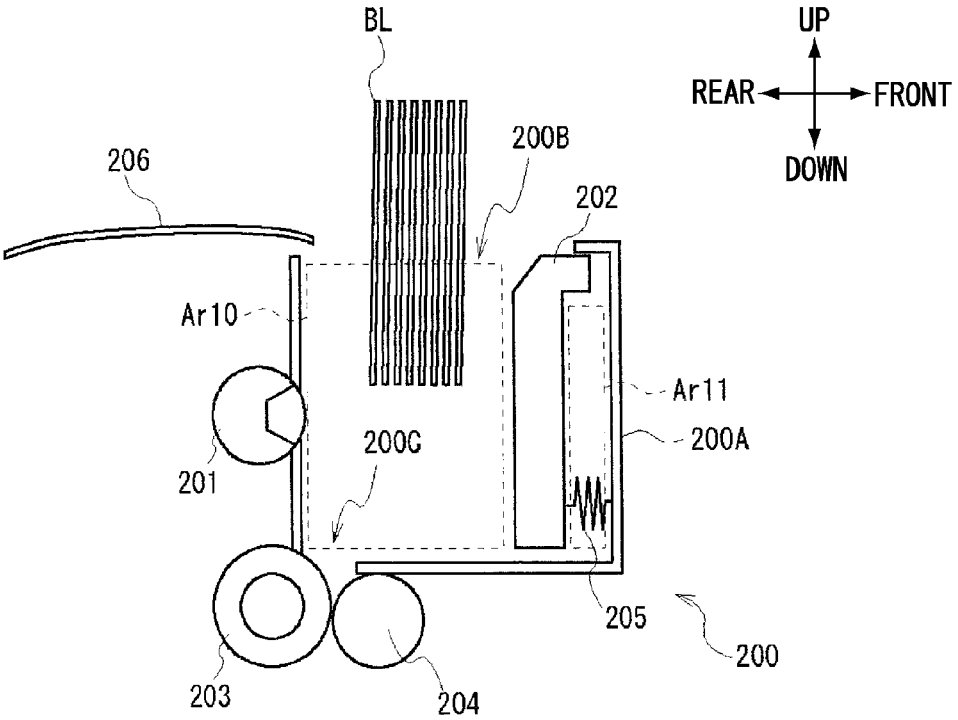
FIG.19A RELATED ART
FIG. 19A is a schematic line drawing illustrating a configuration of a pay-in section of related art.
Figure 19B:
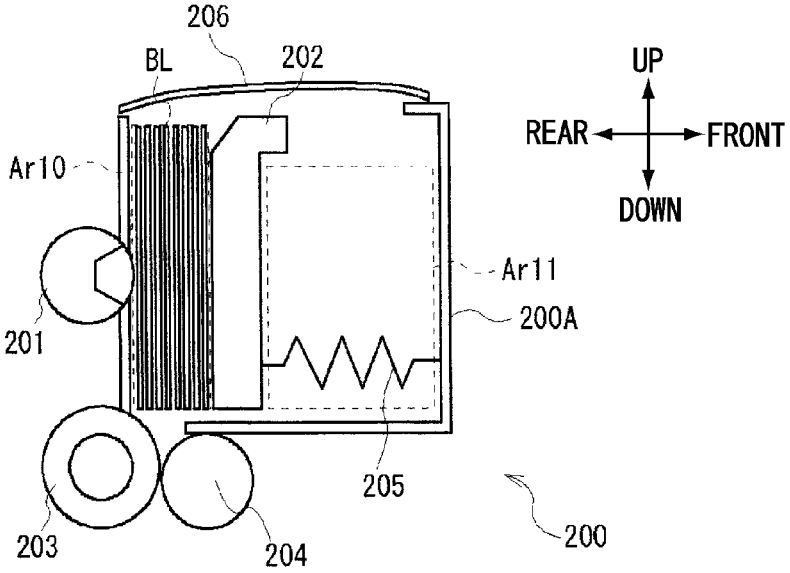
FIG.19B RELATED ART
FIG. 19B is a schematic line drawing illustrating a configuration of a pay-in section of related art.

Moreover, as illustrated in FIG. 18, for example a cover 98 may be provided over a front end portion of the upper end of the holding section 3B so as to cover the rear portion 90B of the bill press shutter 91 that projects upward when folded. So doing enables damage to the upward projecting rear portion 90B to be prevented.

3-4. Other Exemplary Embodiment 4

In the first exemplary embodiment described above, a mechanism configured by the four shaft bearings 40A, 40B, 41A, 41B, and the shaft 42 is employed as the coupling 30 of the bill press shutter 25.

There is no limitation thereto, and a different mechanism to the mechanism configured by the four shaft bearings 40A, 40B, 41A, 41B, and the shaft 42 may be employed as long as it is a mechanism capable of coupling so as to allow free rotation between the front wall of the holding section 3B and the first member 26A. The same applies for the other couplings 31A, 31B, 32.

3-5. Other Exemplary Embodiment 5

In the first exemplary embodiment described above, the shaft holes 46 of the coupling 32 have an elliptical shape in order to allow tilting of the bill press 21.

There is no limitation thereto, and the shape of the shaft holes 46 may, for example, be a round-cornered rectangular shape resembling that of an athletics track. Making such a configuration also allows tilting of the bill press 21.

3-6. Other Exemplary Embodiment 6

The explanation thus far has employed the bill press 21 as an example of a medium press, and the bill press shutters 25, 60, 70, 80, 91 as examples of an opening out section; however there is no limitation thereto. Medium presses and opening out sections with different mechanisms to those of the bill press 21 and the bill press shutters 25, 60, 70, 80, 91 may be employed as long as they serve similar functions.

3-7. Other Exemplary Embodiment 7

In the exemplary embodiments described above, the present invention is applied to the banknote processing device 1 serving as a cashier/customer operated terminal operated by a cashier or customer; however the present invention is not limited thereto. The present invention may be applied to various devices such as ATMs, for example, as long as they are devices including a dedicated mechanism for pay-in such as the pay-in section 3.

In the exemplary embodiments described above, the present invention is applied to the banknote processing device 1 that handles banknotes; however there is no limitation thereto. The present invention may, for example, be applied to medium processing devices for processing sheets of paper other than banknotes, such as paper, tickets or the like, as long as it is a medium processing device including a function similar to that of the pay-in section 3.

3-8. Other Exemplary Embodiment 8

The present invention is not limited to the exemplary embodiments described above, nor to the other exemplary embodiments. Namely, the scope of application of the present invention covers any combination of some or all of the exemplary embodiments and other exemplary embodiments described above, and exemplary embodiments extrapolated therefrom.

The disclosure of Japanese Patent Application No. 2012-250238 is incorporated in its entirety into the present specification by reference.

All publications, patent applications and technical standards mentioned in the present specification are incorporated by reference in the present specification to the same extent as if the individual publication, patent application, or technical standard was specifically and individually indicated to be incorporated by reference.

INDUSTRIAL APPLICABILITY

The present invention may be employed in a wide range of devices such as banknote processing devices that handle banknotes.

The invention claimed is:

1. A medium processing device, comprising:

a holding section that has a first end side wall, a second end side wall, an opening that defines a medium insertion port, a medium holding area that holds a medium inserted through the medium insertion port, and an intake port though which the medium held in the medium holding area is fed;

a medium press section that is movable between the first end side wall and the second end side wall, the medium press section being positioned at an initial position in a vicinity of the first end side wall, and when a medium is inserted into the medium holding area through the medium insertion port, the medium press section moves toward the second end side wall and presses the inserted medium against the second end side wall; and a folding shutter that includes two plate-shaped members coupled together by a hinge at a connection position, the folding shutter being movable between a folded-up position at which the medium press section is in the initial position, and an open position, in the folded-up position, the two plate-shaped members are rotated at the connection position so as to come closer to each other, and in the open position, the two plate-shaped members are rotated at the connection position so as to move away from each other, and cover a medium non-holding area defined between the first end side wall and the medium press section, wherein when the folding shutter is in the folded-up position, the two plate-shaped members are housed in the medium non-holding area.

2. The medium processing device of claim 1, wherein the medium press section is coupled to one end of the folding shutter so as to be capable of tilting with respect to the second end side wall.

3. The medium processing device of claim 1, further including a cover that is provided at the first end side wall and that covers the folding shutter housed in the medium non-holding area when the folding shutter is in the folded-up position.

4. The medium processing device of claim 1, wherein the two plate-shaped members include a first side member and a second side member, and the second side member is longer than the first side member in an opening out direction of the folding shutter so that a part of the second side member passes the medium press section, projects out from the medium press section to the second end side wall, and covers at least a part of the medium holding area defined between the medium press section and the second end side wall, when the medium press section is in the open position.

5. The medium processing device of claim 1, wherein when the folding shutter is in the folded-up position, the medium insertion port of the holding section has an open area uncovered by the folding shutter.

6. A medium processing device, comprising:

a holding section that has a first end side wall, a second end side wall, an opening that defines a medium insertion port, a medium holding area that holds a medium inserted through the medium insertion port, and an intake port though which the medium held in the medium holding area is fed;

a medium press section that is movable between the first end side wall and the second end side wall, the medium press section being positioned at an initial position in a vicinity of the first end side wall, and when a medium is inserted into the medium holding area through the medium insertion port, the medium press section moves toward the second end side wall and presses the inserted medium against the second end side wall; and a folding shutter that includes a plurality of overlapping plate-shaped members slidably coupled together, the folding shutter being movable between a folded-up position at which the medium press section is in the initial position, and an open position, in the folded-up position, the plurality of plate-shaped members are folded up such that the plurality of plate-shaped members overlap each other in a layered arrangement, and in the open position, the plurality of plate-shaped members slide such that respective overlapping portions between the plurality of plate-shaped members get smaller, and cover a medium non-holding area defined between the first end side wall and the medium press section.

7. The medium processing device of claim 6, wherein the medium press section is coupled to one end of the folding shutter so as to be capable of tilting with respect to the second end side wall.

8. The medium processing device of claim 6, further including a cover that is provided at the first end side wall and that covers the folding shutter housed in the medium non-holding area when the folding shutter is in the folded-up position.

9. A medium processing device, comprising:

a holding section that has a first end side wall, a second end side wall, an opening that defines a medium insertion port, a medium holding area that holds a medium inserted through the medium insertion port, and an intake port though which the medium held in the medium holding area is fed;

a medium press section that is movable between the first end side wall and the second end side wall, the medium press section being positioned at an initial position in a vicinity of the first end side wall, and when a medium is inserted into the medium holding area through the medium insertion port, the medium press section moves toward the second end side wall and presses the inserted medium against the second end side wall; and a folding shutter that comprises a film-shaped material, the folding shutter being movable between a folded-up position at which the medium press section is in the initial position, and an open position, in the folded-up position, the folding shutter is folded up by warping, and in the open position, the folding shutter opens out by spreading so as to reduce warping and covers a medium non-holding area defined between the first end side wall and the medium press section.

10. The medium processing device of claim 9, wherein the medium press section is coupled to one end of the folding shutter so as to be capable of tilting with respect to the second end side wall.

11. The medium processing device of claim 9, further including a cover that is provided at the first end side wall and that covers the folding shutter housed in the medium non-holding area when the folding shutter is in the folded-up position.

* * * * *